US008113942B2

(12) United States Patent
Hoffman et al.

(10) Patent No.: US 8,113,942 B2
(45) Date of Patent: Feb. 14, 2012

(54) GAMING SYSTEM AND METHOD HAVING A BONUS SEQUENCE WITH AVAILABLE SYMBOLS DETERMINED IN A BASE GAME

(75) Inventors: Benjamin C. Hoffman, Reno, NV (US); Paulina Rodgers, Reno, NV (US); Christmas C. Parker, Reno, NV (US)

(73) Assignee: IGT, Reno, NV (US)

( * ) Notice: Subject to any disclaimer, the term of this patent is extended or adjusted under 35 U.S.C. 154(b) by 578 days.

(21) Appl. No.: 12/268,552

(22) Filed: Nov. 11, 2008

(65) Prior Publication Data

US 2010/0120493 A1 May 13, 2010

(51) Int. Cl.
*A63F 9/24* (2006.01)

(52) U.S. Cl. ..... 463/20

(58) Field of Classification Search ..... 463/20
See application file for complete search history.

(56) References Cited

U.S. PATENT DOCUMENTS

| | | | |
|---|---|---|---|
| 4,695,053 | A | 9/1987 | Vazquez, Jr. et al. |
| 4,991,848 | A | 2/1991 | Greenwood et al. |
| 5,046,735 | A | 9/1991 | Hamano et al. |
| 5,152,529 | A | 10/1992 | Okada |
| 5,393,061 | A | 2/1995 | Manship et al. |
| 5,395,111 | A | 3/1995 | Inoue |
| 5,449,173 | A | 9/1995 | Thomas et al. |
| 5,456,465 | A | 10/1995 | Durham |
| 5,611,535 | A | 3/1997 | Tiberio |
| 5,647,798 | A | 7/1997 | Falciglia |
| 5,655,961 | A | 8/1997 | Acres et al. |
| 5,722,891 | A | 3/1998 | Inoue |
| 5,775,692 | A | 7/1998 | Watts et al. |
| 5,788,573 | A | 8/1998 | Baerlocher et al. |
| 5,823,873 | A | 10/1998 | Moody |
| 5,833,537 | A | 11/1998 | Barrie |
| 5,876,284 | A | 3/1999 | Acres et al. |
| 5,947,820 | A | 9/1999 | Morro et al. |
| 5,976,016 | A | 11/1999 | Moody et al. |

(Continued)

FOREIGN PATENT DOCUMENTS

AU P 07780 7/1997

(Continued)

OTHER PUBLICATIONS

Elvis Advertisement, written by IGT, published in 1999.

(Continued)

*Primary Examiner* — Dmitry Suhol
*Assistant Examiner* — Michael Grant
(74) *Attorney, Agent, or Firm* — K&L Gates LLP

(57) ABSTRACT

In one embodiment, the gaming system includes a plurality of symbols for a play of the primary game, wherein at least one symbol from this set of symbols is a designated symbol. In this embodiment, for a play of the primary game, the gaming system randomly displays a plurality of symbols from the set of symbols. If the plurality of displayed symbols include a designated symbol, the gaming system triggers a bonus sequence, determines a number of bonus symbol generations for the bonus sequence, and determines which symbols are displayed in symbol position locations relative to or having a predetermined relationship to the symbol position location of the displayed designated symbol. The gaming system then determines a sub-set of symbols which includes the symbols that were determined to be displayed in symbol position locations relative to or having a predetermined relationship to the symbol position location of the designated symbol.

43 Claims, 12 Drawing Sheets

U.S. PATENT DOCUMENTS

| | | | | |
|---|---|---|---|---|
| 5,980,384 | A | 11/1999 | Barrie | |
| 5,984,781 | A | 11/1999 | Sunaga | |
| 5,984,782 | A | 11/1999 | Inoue | |
| 5,997,401 | A | 12/1999 | Crawford | |
| 6,004,207 | A | 12/1999 | Wilson, Jr. et al. | |
| 6,033,307 | A | 3/2000 | Vancura | |
| 6,056,642 | A | 5/2000 | Bennett | |
| 6,059,289 | A | 5/2000 | Vancura | |
| 6,089,977 | A | 7/2000 | Bennett | |
| 6,102,798 | A | 8/2000 | Bennett | |
| 6,120,378 | A | 9/2000 | Moody et al. | |
| 6,126,541 | A | 10/2000 | Fuchs | |
| 6,126,542 | A | 10/2000 | Fier | |
| 6,142,873 | A | 11/2000 | Weiss et al. | |
| 6,142,874 | A | 11/2000 | Kodachi et al. | |
| 6,142,875 | A | 11/2000 | Kodachi et al. | |
| 6,162,121 | A | 12/2000 | Morro et al. | |
| 6,168,520 | B1 | 1/2001 | Baerlocher et al. | |
| 6,217,448 | B1 | 4/2001 | Olsen | |
| 6,227,971 | B1 | 5/2001 | Weiss | |
| 6,238,287 | B1 | 5/2001 | Komori et al. | |
| 6,251,013 | B1 | 6/2001 | Bennett | |
| 6,270,412 | B1 | 8/2001 | Crawford et al. | |
| 6,290,600 | B1 | 9/2001 | Glasson | |
| 6,299,165 | B1 | 10/2001 | Nagano | |
| 6,311,976 | B1 | 11/2001 | Yoseloff et al. | |
| 6,312,334 | B1 | 11/2001 | Yoseloff | |
| 6,315,660 | B1 | 11/2001 | DeMar et al. | |
| 6,331,143 | B1 | 12/2001 | Yoseloff | |
| 6,364,766 | B1 | 4/2002 | Anderson et al. | |
| 6,375,570 | B1 | 4/2002 | Poole | |
| 6,394,902 | B1 | 5/2002 | Glavich et al. | |
| 6,398,218 | B1 | 6/2002 | Vancura | |
| 6,439,993 | B1 | 8/2002 | O'Halloran | |
| 6,443,452 | B1 | 9/2002 | Brune | |
| 6,491,584 | B2 | 12/2002 | Graham et al. | |
| 6,517,432 | B1 | 2/2003 | Jaffe | |
| 6,551,187 | B1 | 4/2003 | Jaffe | |
| 6,561,900 | B1 | 5/2003 | Baerlocher et al. | |
| 6,561,904 | B2 | 5/2003 | Locke et al. | |
| 6,565,433 | B1 | 5/2003 | Baerlocher et al. | |
| 6,575,830 | B2 | 6/2003 | Baerlocher et al. | |
| 6,585,591 | B1 | 7/2003 | Baerlocher et al. | |
| 6,599,185 | B1 | 7/2003 | Kaminkow et al. | |
| 6,602,135 | B1 | 8/2003 | Gerrard | |
| 6,602,136 | B1 | 8/2003 | Baerlocher et al. | |
| 6,602,137 | B2 | 8/2003 | Kaminkow et al. | |
| 6,604,740 | B1 | 8/2003 | Singer et al. | |
| 6,632,140 | B2 | 10/2003 | Berman et al. | |
| 6,634,943 | B1 | 10/2003 | Baerlocher | |
| 6,648,757 | B1 * | 11/2003 | Slomiany et al. | 463/20 |
| 6,648,759 | B2 | 11/2003 | Vancura | |
| 6,672,960 | B1 | 1/2004 | B-Jensen | |
| 6,702,675 | B2 | 3/2004 | Poole et al. | |
| 6,731,313 | B1 | 5/2004 | Kaminkow | |
| 6,733,386 | B2 | 5/2004 | Cuddy et al. | |
| 6,739,973 | B1 | 5/2004 | Lucchesi et al. | |
| 6,776,711 | B1 | 8/2004 | Baerlocher | |
| 6,780,105 | B1 | 8/2004 | Kaminkow | |
| 6,802,775 | B2 | 10/2004 | Baerlocher et al. | |
| 6,805,632 | B2 | 10/2004 | Suda | |
| 6,811,483 | B1 | 11/2004 | Webb et al. | |
| 6,811,485 | B2 | 11/2004 | Kaminkow | |
| 6,817,943 | B2 | 11/2004 | Gerrard | |
| 6,817,944 | B2 | 11/2004 | Kaminkow et al. | |
| 6,855,054 | B2 | 2/2005 | White et al. | |
| 6,863,607 | B2 | 3/2005 | Gerrard | |
| 6,890,257 | B2 | 5/2005 | Baerlocher | |
| 6,899,620 | B2 | 5/2005 | Kaminkow et al. | |
| 6,905,405 | B2 | 6/2005 | McClintic | |
| 6,905,406 | B2 * | 6/2005 | Kaminkow et al. | 463/20 |
| 6,908,383 | B2 | 6/2005 | Baerlocher et al. | |
| 6,910,962 | B2 | 6/2005 | Marks | |
| 6,913,532 | B2 | 7/2005 | Baerlocher et al. | |
| 6,913,533 | B2 | 7/2005 | Cuddy et al. | |
| 6,918,832 | B2 | 7/2005 | Baerlocher et al. | |
| 6,939,223 | B1 | 9/2005 | Jones | |
| 6,955,600 | B2 | 10/2005 | Glavich et al. | |
| 6,958,013 | B2 | 10/2005 | Miereau et al. | |
| 6,960,134 | B2 | 11/2005 | Hartl et al. | |
| 6,971,955 | B2 | 12/2005 | Baerlocher et al. | |
| 6,979,263 | B2 | 12/2005 | Baerlocher et al. | |
| 6,981,635 | B1 | 1/2006 | Hughs-Baird et al. | |
| 6,986,710 | B2 | 1/2006 | Baerlocher et al. | |
| 6,988,947 | B2 | 1/2006 | Baerlocher et al. | |
| 6,991,538 | B2 | 1/2006 | Cannon | |
| 6,997,804 | B2 | 2/2006 | Berman | |
| 7,052,395 | B2 | 5/2006 | Glavich et al. | |
| 7,056,213 | B2 | 6/2006 | Ching et al. | |
| 7,056,214 | B2 | 6/2006 | Miereau et al. | |
| 7,066,814 | B2 | 6/2006 | Glavich et al. | |
| 7,074,127 | B2 | 7/2006 | Cuddy et al. | |
| 7,077,745 | B2 | 7/2006 | Gomez et al. | |
| 7,090,580 | B2 | 8/2006 | Rodgers et al. | |
| 7,094,148 | B2 | 8/2006 | Baerlocher et al. | |
| 7,104,886 | B2 | 9/2006 | Baerlocher et al. | |
| 7,104,888 | B2 | 9/2006 | Miereau et al. | |
| 7,118,110 | B2 | 10/2006 | Kowalczyk | |
| 7,121,942 | B2 | 10/2006 | Baerlocher | |
| 7,153,205 | B2 | 12/2006 | Baerlocher | |
| 7,160,186 | B2 | 1/2007 | Cuddy et al. | |
| 7,169,042 | B2 | 1/2007 | Muir et al. | |
| 7,235,011 | B2 | 6/2007 | Randall et al. | |
| 7,238,110 | B2 | 7/2007 | Glavich et al. | |
| 7,258,611 | B2 | 8/2007 | Bigelow, Jr. et al. | |
| 7,258,613 | B2 | 8/2007 | Lucchesi et al. | |
| 7,281,997 | B2 | 10/2007 | Kennedy, III et al. | |
| 7,314,409 | B2 | 1/2008 | Maya et al. | |
| 7,322,887 | B2 | 1/2008 | Belger et al. | |
| 7,331,862 | B2 | 2/2008 | Rodgers et al. | |
| 7,331,866 | B2 | 2/2008 | Rodgers et al. | |
| 7,331,867 | B2 | 2/2008 | Baerlocher et al. | |
| 7,338,367 | B2 | 3/2008 | Kaminkow et al. | |
| 7,338,369 | B2 | 3/2008 | Mierau et al. | |
| 7,357,713 | B2 | 4/2008 | Marks et al. | |
| 7,361,089 | B2 | 4/2008 | Daly et al. | |
| 7,371,168 | B2 | 5/2008 | Bilyeu et al. | |
| 7,371,169 | B2 | 5/2008 | Baerlocher | |
| 7,371,170 | B2 | 5/2008 | Cregan et al. | |
| 7,381,134 | B2 | 6/2008 | Cuddy et al. | |
| 7,384,334 | B2 | 6/2008 | Glavich et al. | |
| 7,399,228 | B2 | 7/2008 | Baerlocher | |
| 7,402,102 | B2 | 7/2008 | Marks et al. | |
| 7,402,103 | B2 | 7/2008 | Baerlocher | |
| 7,413,508 | B2 | 8/2008 | Nelson et al. | |
| 7,473,174 | B2 | 1/2009 | Cuddy et al. | |
| 7,481,708 | B2 | 1/2009 | Baerlocher et al. | |
| 2001/0009865 | A1 | 7/2001 | DeMar et al. | |
| 2002/0052233 | A1 | 5/2002 | Gauselmann | |
| 2002/0086725 | A1 | 7/2002 | Fasbender et al. | |
| 2002/0119818 | A1 | 8/2002 | Savio et al. | |
| 2003/0036423 | A1 | 2/2003 | Vancura | |
| 2003/0045343 | A1 | 3/2003 | Luccesi et al. | |
| 2003/0060272 | A1 | 3/2003 | Glavich et al. | |
| 2003/0064779 | A1 | 4/2003 | Suda | |
| 2003/0100356 | A1 | 5/2003 | Brown | |
| 2003/0190948 | A1 | 10/2003 | Baerlocher et al. | |
| 2003/0199301 | A1 | 10/2003 | Gerrard | |
| 2003/0216165 | A1 | 11/2003 | Singer et al. | |
| 2004/0038730 | A1 | 2/2004 | Suda | |
| 2004/0048646 | A1 | 3/2004 | Visocnik | |
| 2004/0048651 | A1 | 3/2004 | Vorias | |
| 2004/0053669 | A1 | 3/2004 | Gerrard | |
| 2004/0053671 | A1 | 3/2004 | Nordman | |
| 2004/0053673 | A1 | 3/2004 | Mishra | |
| 2004/0053677 | A1 | 3/2004 | Hughs-Baird | |
| 2004/0053683 | A1 | 3/2004 | Hartl | |
| 2004/0063487 | A1 | 4/2004 | Gerrard | |
| 2004/0063493 | A1 | 4/2004 | Baerlocher | |
| 2004/0077396 | A1 | 4/2004 | Poole | |
| 2004/0097286 | A1 | 5/2004 | Vancura | |
| 2004/0132527 | A1 | 7/2004 | Berman | |
| 2004/0152500 | A1 | 8/2004 | Baerlocher | |
| 2004/0171420 | A1 | 9/2004 | Baerlocher et al. | |
| 2004/0180714 | A1 | 9/2004 | Ward | |
| 2004/0198486 | A1 | 10/2004 | Walker et al. | |
| 2004/0198489 | A1 | 10/2004 | Kaminkow et al. | |

2004/0242302 A1 12/2004 Baerlocher
2004/0266512 A1 12/2004 Kaminkow
2005/0003884 A1 1/2005 Meyer et al.
2005/0020346 A1 1/2005 Baerlocher
2005/0026679 A1 2/2005 Lucchesi et al.
2005/0054418 A1 3/2005 Baerlocher
2005/0054436 A1 3/2005 Frizzel et al.
2005/0059446 A1 3/2005 Kaminkow
2005/0059462 A1 3/2005 Gerrard
2005/0071023 A1 3/2005 Gilliland et al.
2005/0075163 A1 4/2005 Cuddy et al.
2005/0077681 A1 4/2005 Kowalczyk
2005/0096121 A1 5/2005 Gilliland et al.
2005/0101372 A1 5/2005 Mierau et al.
2005/0116417 A1 6/2005 Soltys et al.
2005/0119043 A1 6/2005 Berman et al.
2005/0159208 A1 7/2005 Pacey
2005/0233796 A1 10/2005 Baerlocher et al.
2005/0266917 A1 12/2005 Glavich et al.
2006/0009277 A1 1/2006 Hartl et al.
2006/0063582 A1 3/2006 Baerlocher et al.
2006/0063585 A1 3/2006 Cuddy
2006/0068882 A1 3/2006 Baerlocher et al.
2006/0068883 A1 3/2006 Randall et al.
2006/0068884 A1 3/2006 Baerlocher et al.
2006/0068885 A1 3/2006 Cregan et al.
2006/0073876 A1 4/2006 Cuddy
2006/0073879 A1 4/2006 Baerlocher
2006/0079309 A1 4/2006 Walker et al.
2006/0084487 A1 4/2006 Pierce et al.
2006/0084493 A1 4/2006 Pederson et al.
2006/0084494 A1 4/2006 Belger et al.
2006/0084500 A1 4/2006 Baerlocher et al.
2006/0116191 A1 6/2006 Vancura
2006/0116196 A1 6/2006 Vancura
2006/0199636 A1 9/2006 Ching et al.
2006/0199637 A1 9/2006 Ching et al.
2006/0205480 A1 9/2006 Glavich
2006/0205493 A1 9/2006 Fujimoto
2006/0246989 A1 11/2006 Glavich et al.
2006/0247040 A1 11/2006 Walker et al.
2006/0287036 A1 12/2006 Daly et al.
2006/0287041 A1 12/2006 Walker et al.
2007/0004489 A1 1/2007 Rodgers et al.
2007/0010316 A1 1/2007 Baerlocher et al.
2007/0021188 A1 1/2007 Rodgers et al.
2007/0049372 A1 3/2007 Olivas et al.
2007/0060287 A1 3/2007 Reddicks et al.
2007/0087809 A1 4/2007 Baerlocher
2007/0111783 A1 5/2007 Cuddy et al.
2007/0117610 A1 5/2007 Webb et al.
2007/0129134 A1 6/2007 Barrie
2007/0135203 A1 6/2007 Nicely
2007/0178957 A1 8/2007 Cabot et al.
2007/0281778 A1 12/2007 Bigelow, Jr. et al.
2007/0287521 A1 12/2007 Glavich et al.
2007/0287529 A1 12/2007 Kojima
2008/0020836 A1 1/2008 Lucchesi et al.
2008/0064487 A1 3/2008 Stevens et al.
2008/0085759 A1 4/2008 Bilyeu et al.
2008/0090655 A1 4/2008 Marks et al.
2008/0102931 A1 5/2008 Marks et al.
2008/0113735 A1 5/2008 Maya
2008/0113742 A1 5/2008 Amos et al.
2008/0113760 A1 5/2008 Baerlocher
2008/0113761 A1 5/2008 Belger
2008/0113765 A1 5/2008 Dewaal
2008/0113779 A1 5/2008 Cregan
2008/0139296 A1 6/2008 Baerlocher et al.
2008/0139298 A1 6/2008 Rodgers et al.
2008/0153584 A1 6/2008 Cuddy et al.
2008/0200232 A1 8/2008 Baerlocher et al.
2008/0200237 A1 8/2008 Cuddy et al.
2008/0207298 A1 8/2008 Marks et al.
2008/0207305 A1 8/2008 Cregan et al.
2008/0214283 A1 9/2008 Cregan et al.
2008/0220851 A1 9/2008 Glavich et al.
2008/0304717 A1 12/2008 Tsuruta
2009/0017906 A1 1/2009 Jackson
2010/0190544 A1* 7/2010 Thomas ..... 463/20

FOREIGN PATENT DOCUMENTS

| | | |
|---|---|---|
| EP | 0 060 019 | 9/1982 |
| EP | 0 874 337 | 10/1998 |
| EP | 0 926 645 | 6/1999 |
| GB | 2 101 380 | 1/1983 |
| GB | 2 262 642 | 6/1993 |
| WO | WO 97/32285 | 9/1997 |
| WO | WO 98/55191 | 12/1998 |
| WO | WO 2004/082779 | 9/2004 |
| WO | WO 2006/063173 | 6/2006 |
| WO | WO 2007/033287 | 3/2007 |
| WO | WO 2007/076321 | 5/2007 |
| WO | WO 2007/084766 | 7/2007 |

OTHER PUBLICATIONS

Little Devil Advertisement, written by IGT, published in 1998.
Slot Machines Article, written by Marshal Fey, published in 1989.
Slotopoly Advertisement, written by IGT, published in 1998.
Super Cherry Advertisement written by IGT, published in 2001.
Top Dollar Advertisement, written by IGT, published in 1998.
Totem Pole Advertisement, written by IGT, published in 1997.
Wheel of Fortune Video Advertisement, written by IGT, published in 1999.
Winning Streak Advertisement, written by Aristocrat, published in 1994.

* cited by examiner

FIG. 5

| Free Spin | Free Spin Award Amount |
|---|---|
| 1 | 20 |
| 2 | 0 |
| 3 | 10 |
| 4 | 5 |
| 5 | 0 |
| 6 | 0 |
| 7 | 20 |
| 8 | 20 |
| 9 | 10 |
| 10 | 0 |

Total Award: 85

GAMING SYSTEM AND METHOD HAVING A BONUS SEQUENCE WITH AVAILABLE SYMBOLS DETERMINED IN A BASE GAME

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Generally, symbols or symbol combinations which are less likely to occur usually provide higher awards. In such known gaming machines, the amount of the wager made on the base game by the player may vary.

Gaming machines which provide secondary or bonus games are also known. The secondary or bonus games usually provide an additional award, such as a bonus award, to the player. Secondary or bonus games usually do not require an additional wager by the player to be activated. Instead, secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. When a secondary or bonus game is triggered, the gaming machine generally indicates this triggering to the player through one or more visual and/or audio output devices, such as the reels, lights, speakers, video screens, etc. Part of the enjoyment and excitement of playing certain gaming machines is the occurrence or triggering of the secondary or bonus game (even before the player knows how much the bonus award will be).

Certain known gaming devices have one or more bonus or secondary free spin modes or sequences which are provided to the player after a triggering event in the primary game. The triggering event temporarily halts the primary game play and enables a player to enter the free spin mode or sequence wherein one or more free spins are provided to the player. The player plays the free spin mode or sequence, likely receives an award during one or more of the free spins and returns to the base game. Free spin modes or sequences that provide players with large awards or the potential to win large awards are attractive to players. To increase player enjoyment and excitement, it is desirable to provide players with new types of gaming devices that attract the player and keep the player entertained. Accordingly, a need exists for the further development of secondary games.

SUMMARY

The present disclosure relates in general to a gaming system, and more particularly to a gaming system and method for providing a free spin bonus sequence, wherein the symbols available to be generated in the free spin bonus sequence are symbols that are displayed adjacent to a displayed designated symbol during a play of a primary game.

In one embodiment, the gaming system includes a plurality of symbols from a set or plurality of symbols, wherein at least one symbol from this set of symbols is a designated symbol. In this embodiment, for a play of the primary game, the gaming system randomly generates and displays a plurality of symbols from this set of symbols. If the plurality of generated and displayed symbols include one of the designated symbols, the gaming system triggers a bonus sequence, and determines the number of bonus symbol generations available for the bonus sequence. The gaming system then determines a sub-set of symbols available for the bonus sequence by determining which of the plurality of generated symbols are displayed in symbol position locations relative to or otherwise having a predetermined relationship to the symbol position location of the displayed designated symbol. It should be appreciated that the determined sub-set of symbols available for the bonus sequence includes less than all of the symbols available for the primary game.

After determining the sub-set of symbols, the gaming system provides the bonus sequence by generating and displaying a plurality of symbols from the determined sub-set of symbols for a determined number of bonus symbol generations. For each bonus symbol generation, the gaming system determines if the displayed plurality of symbols from the determined sub-set of symbols form any winning symbol combinations. If the displayed plurality of symbols from the determined sub-set of symbols form any winning symbol combinations, the gaming system provides the player with an award which is associated with such a winning symbol combination. Accordingly, by limiting which symbols are included in the determined sub-set of symbols, the gaming system and method disclosed herein provides players with an increased probability of achieving a winning combination of symbols in the bonus sequence. Such increased probability yields a bonus sequence which provides players with more frequent bonus awards. Moreover, the gaming system and method disclosed herein provides that different bonus sequences will utilize different symbols and different quantities of symbols in the sub-set of symbols. Such different bonus sequences will thus have different probabilities of generating winning symbol combinations and/or different average expected payouts associated with such bonus sequences.

In one embodiment, the gaming system disclosed herein includes a plurality of symbol generators, such as reels, that are each associated with a plurality or set of symbols. At least one symbol from the set of symbols is a designated symbol. In one embodiment, in addition to providing any award for any displayed winning symbol combination in a wagered on primary game, the gaming system determines if a designated symbol is displayed. If the designated symbol is displayed, the gaming system triggers a bonus sequence and determines the number of bonus symbol generations available for the bonus sequence. After determining the number of bonus symbol generations available for the bonus sequence, the gaming system determines which symbols from the plurality of symbols to include in a sub-set of symbols utilized for the bonus sequence.

In one such embodiment, the gaming system determines that the sub-set of symbols for the bonus sequence will include only the symbols from the plurality of symbols that are displayed in symbol position locations relative to or having a predetermined relationship to the symbol position location of a displayed designated symbol. For example, if a designated symbol from a set of symbols is displayed and a bar symbol, a cherry symbol, a bell symbol, and a seven symbol are each displayed in symbol position locations relative to or having a predetermined relationship to the symbol position location of the designated symbol in the play of the primary game, the gaming system determines a sub-set of symbols which includes only bar symbols, cherry symbols, bell symbols, and seven symbols. That is, by eliminating any symbols not determined to be included in the sub-set of symbols, the gaming system determines which symbols to include in the sub-set of symbols.

In one such embodiment, the gaming system designates the symbol positions adjacent to the displayed designated symbol as the symbol position locations having a predetermined relationship to the symbol position location of a displayed designated symbol. In another such embodiment, the gaming system designates the symbol positions directly adjacent to the displayed designated symbol as the symbol position locations having a predetermined relationship to the symbol position location of a displayed designated symbol. In another such embodiment, the gaming system designates the symbol positions indirectly adjacent to the displayed designated symbol as the symbol position locations having a predetermined relationship to the symbol position location of a displayed designated symbol.

After determining which symbols are available for the bonus sequence (i.e., which symbols to include in the sub-set), the gaming system provides the bonus sequence. For each of the determined number of symbol generations available for the bonus sequence, the gaming system generates and displays a plurality of symbols from the sub-set of symbols. After displaying the plurality of symbols from the sub-set of symbols, the gaming system determines if any displayed symbols from the sub-set of symbols form any winning symbol combinations. If any winning symbol combinations of the sub-set of symbols are displayed, the gaming system provides the player any award associated with such a winning symbol combination. For example, if the sub-set of symbols includes only bar symbols and cherry symbols, the gaming system will only generate and display a plurality of bar symbols and cherry symbols for each play of that bonus sequence. After generating the bar symbols and cherry symbols, if any of the displayed bar symbols and cherry symbols form any winning symbol combinations the gaming system provides the player any awards for such a winning symbol combination. In this example, by generating only bar symbols and cherry symbols, the player has an increased probability of achieving a winning symbol combination in the bonus sequence.

The gaming system and method disclosed herein provides players with an increased probability of achieving a winning combination of symbols in the bonus sequence by limiting which symbols are included in the sub-set of symbols and thus reduces the symbols available in the bonus sequence. Such increased probability provides a bonus sequence which provides players with more frequent bonus awards. Accordingly, the gaming system and method disclosed herein provides a bonus sequence wherein one or more of the parameters or characteristics of the bonus sequence are based not only on the symbols randomly generated in the primary game, but also on the positions of these symbols relative to the position of a designated or bonus symbol.

Additional features and advantages are described herein, and will be apparent from the following Detailed Description and the figures.

BRIEF DESCRIPTION OF THE FIGURES

FIG. 5 is a table illustrating an example of the awards provided to a player for each play of a bonus sequence.

DETAILED DESCRIPTION

The present disclosure may be implemented in various configurations for gaming machines, gaming devices, or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
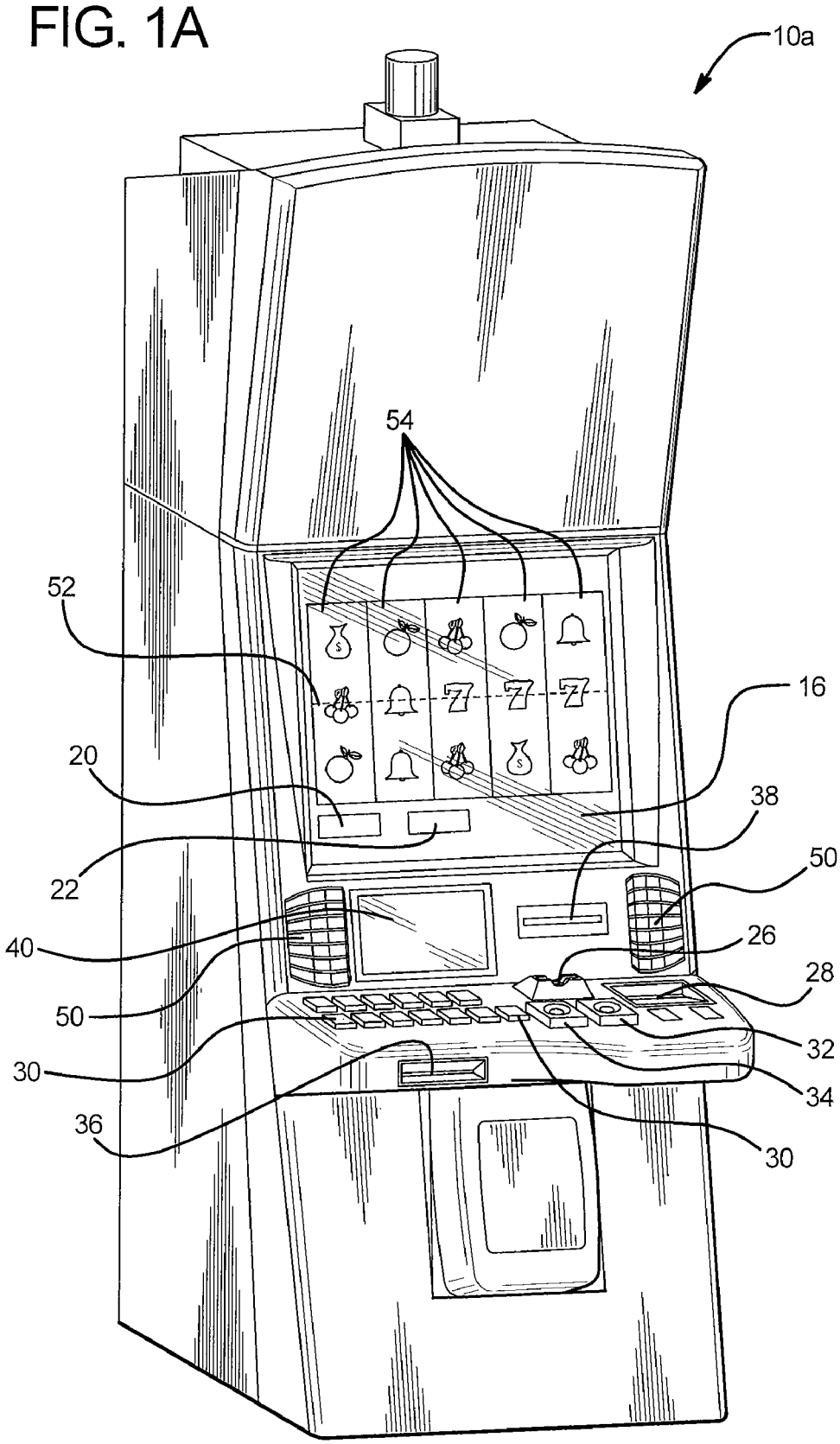
FIGS. 1A and 1B are front perspective views of alternative embodiments of gaming devices disclosed herein.
Figure 1B:
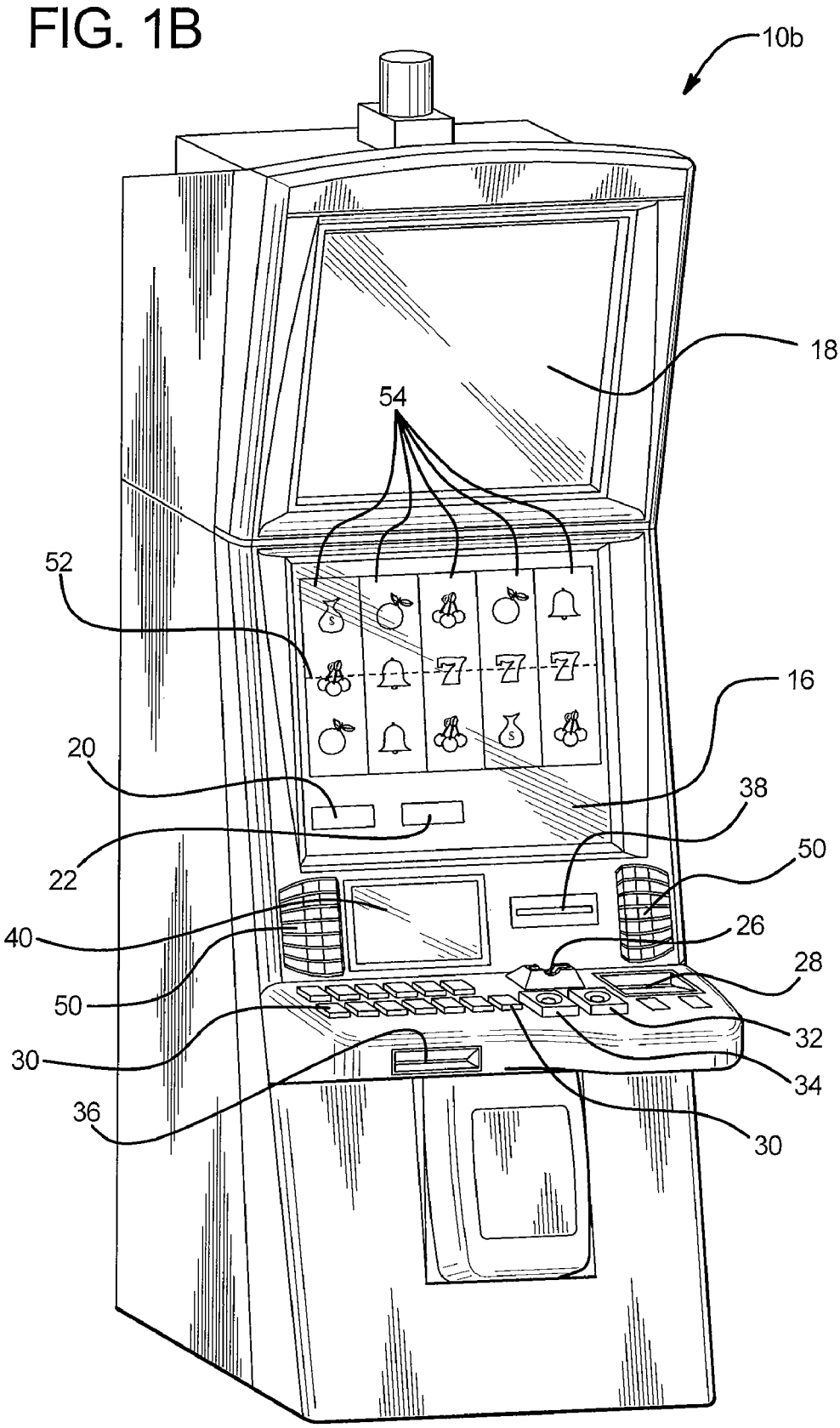

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
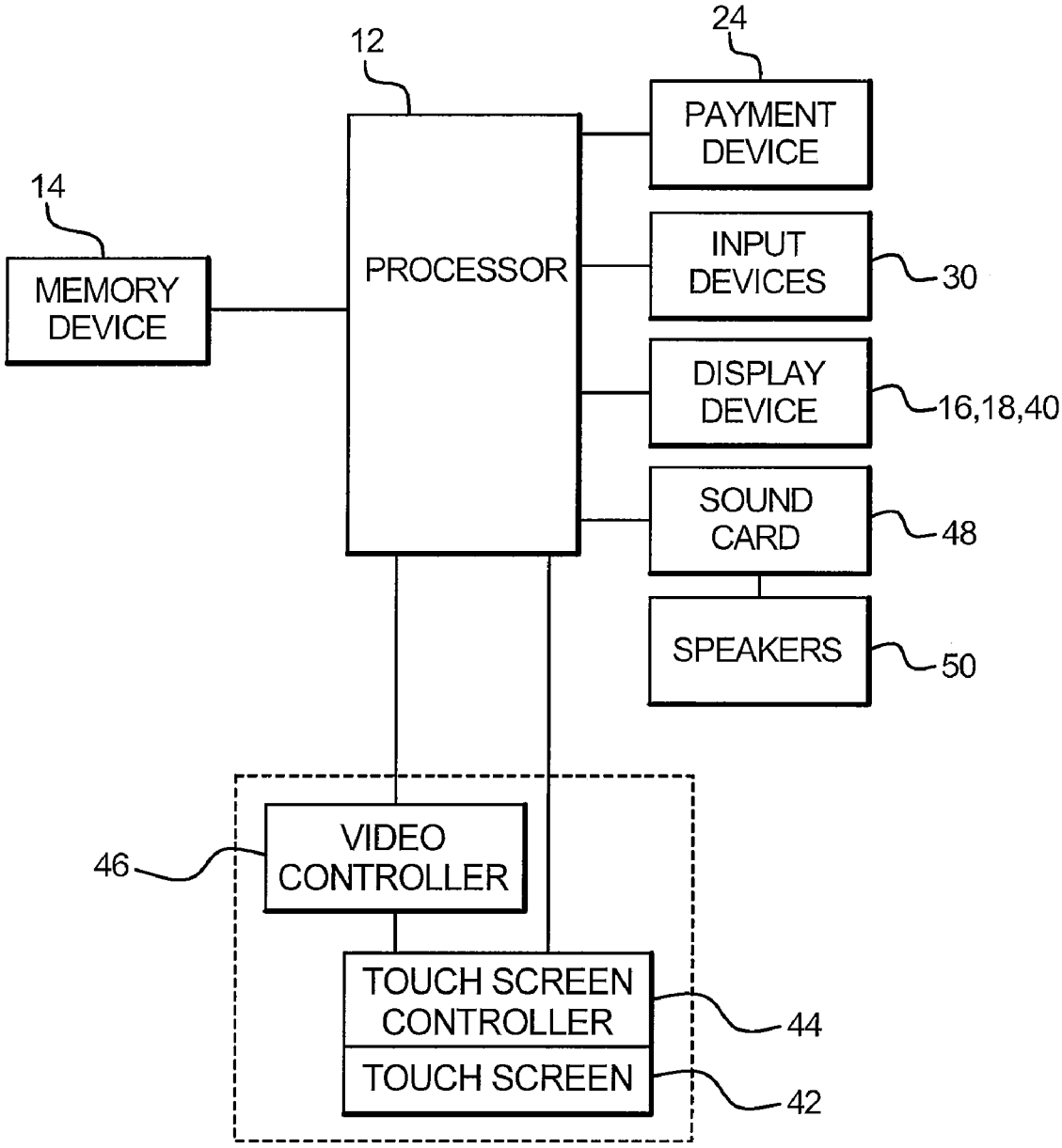
FIG. 2A is a schematic block diagram of the electronic configuration of one embodiment of a gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as described in more detail below, the gaming device includes a player tracking display 40 which displays information regarding a player's play tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering game as the primary or base game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more than one or all of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the number of credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, a base or primary game may be a keno game wherein the gaming device displays a plurality of selectable indicia or numbers on at least one of the display devices. In this embodiment, the player selects at least one bit potentially a plurality of the selectable indicia or numbers via an input device such as a touch screen. The gaming device then displays a series of drawn numbers and determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or in a bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central controller 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
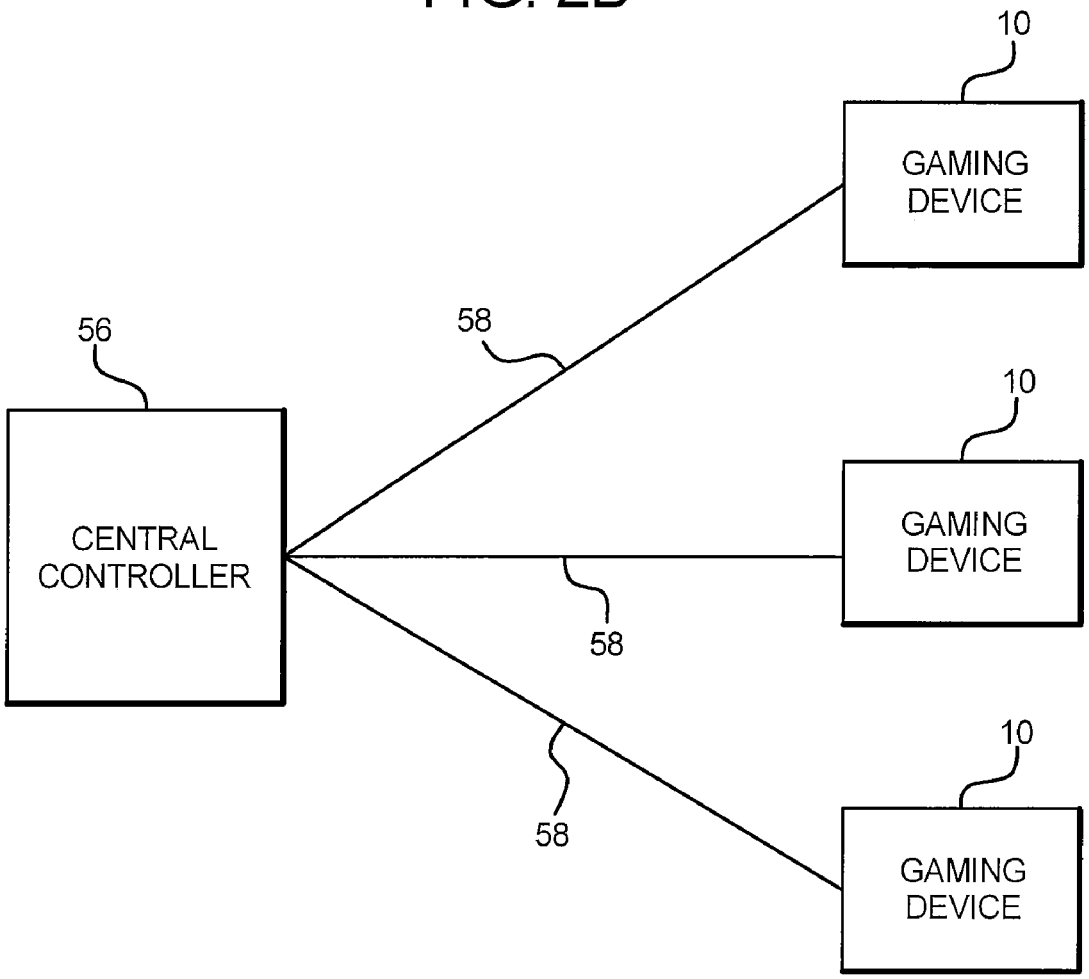
FIG. 2B is a schematic diagram of the central server in communication with a plurality of gaming machines in accordance with one embodiment of the gaming system disclosed herein.

In one embodiment, as illustrated in FIG. 2B, one or more of the gaming devices 10 are in communication with each other and/or at least one central controller 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller, central server or remote host as disclosed herein may be performed by one or more gaming device processors. It should be further appreciated that one, more or each of the functions of one or more gaming device processors as disclosed herein may be performed by the central controller, central server or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game, and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Available Symbols Determined in a Base Game

Figure 3:
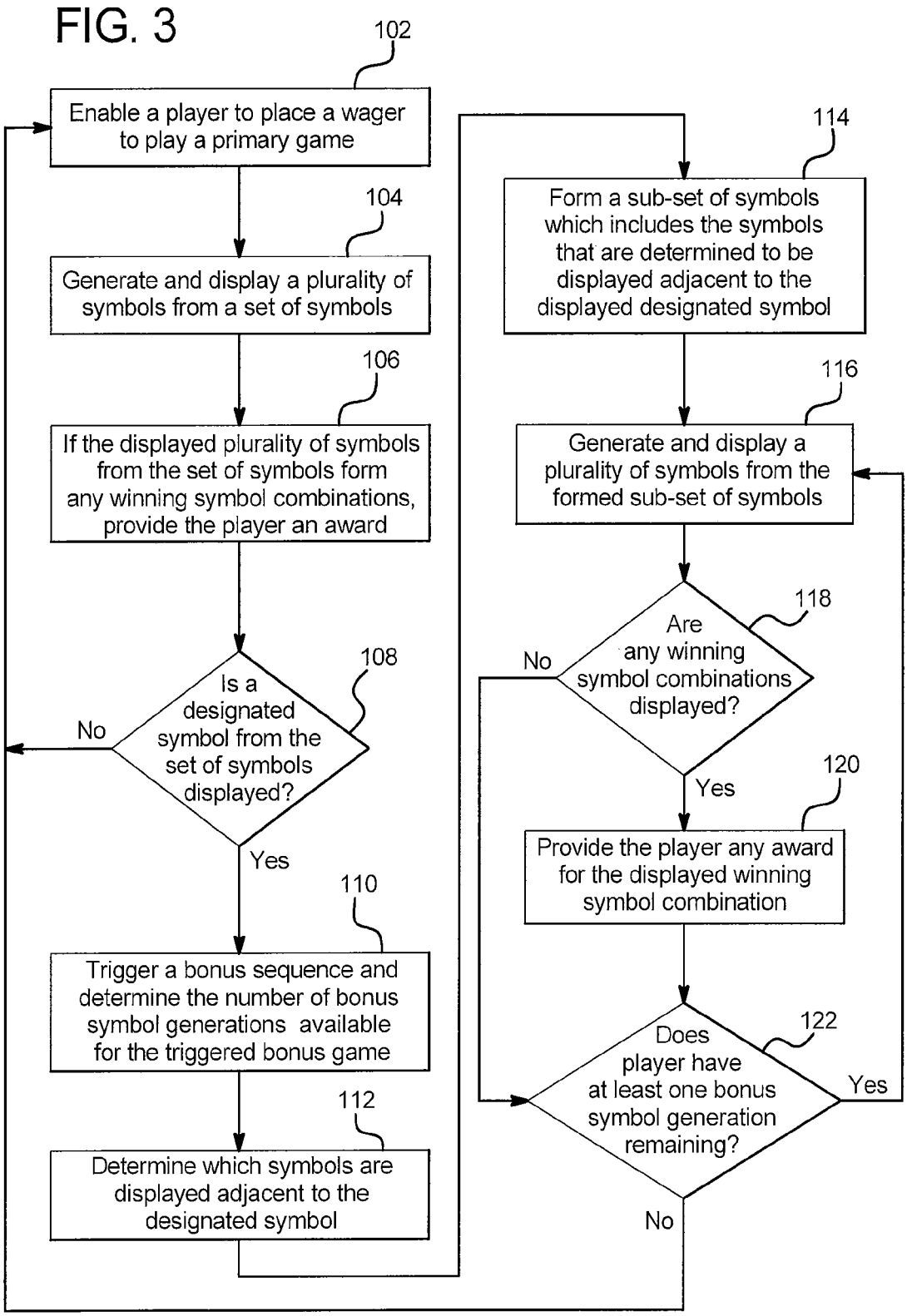
FIG. 3 is a flowchart of one embodiment of the gaming system disclosed herein and illustrating a primary game including a first set of symbols and a bonus sequence including a second set of symbols, wherein the second set of symbols includes symbols generated adjacent to a designated symbol generated in the primary game.

Referring now to FIG. 3, in one embodiment, the gaming system enables a player to place a wager to play a primary game as described above and as indicated in block 102. After the player places a wager, the gaming system generates and displays a plurality of symbols from a set of symbols as indicated by block 104. In one embodiment, at least one symbol of the set of symbols is a designated symbol. In another embodiment, a plurality of symbols of the set of symbols are designated symbols.

Figure 4A:
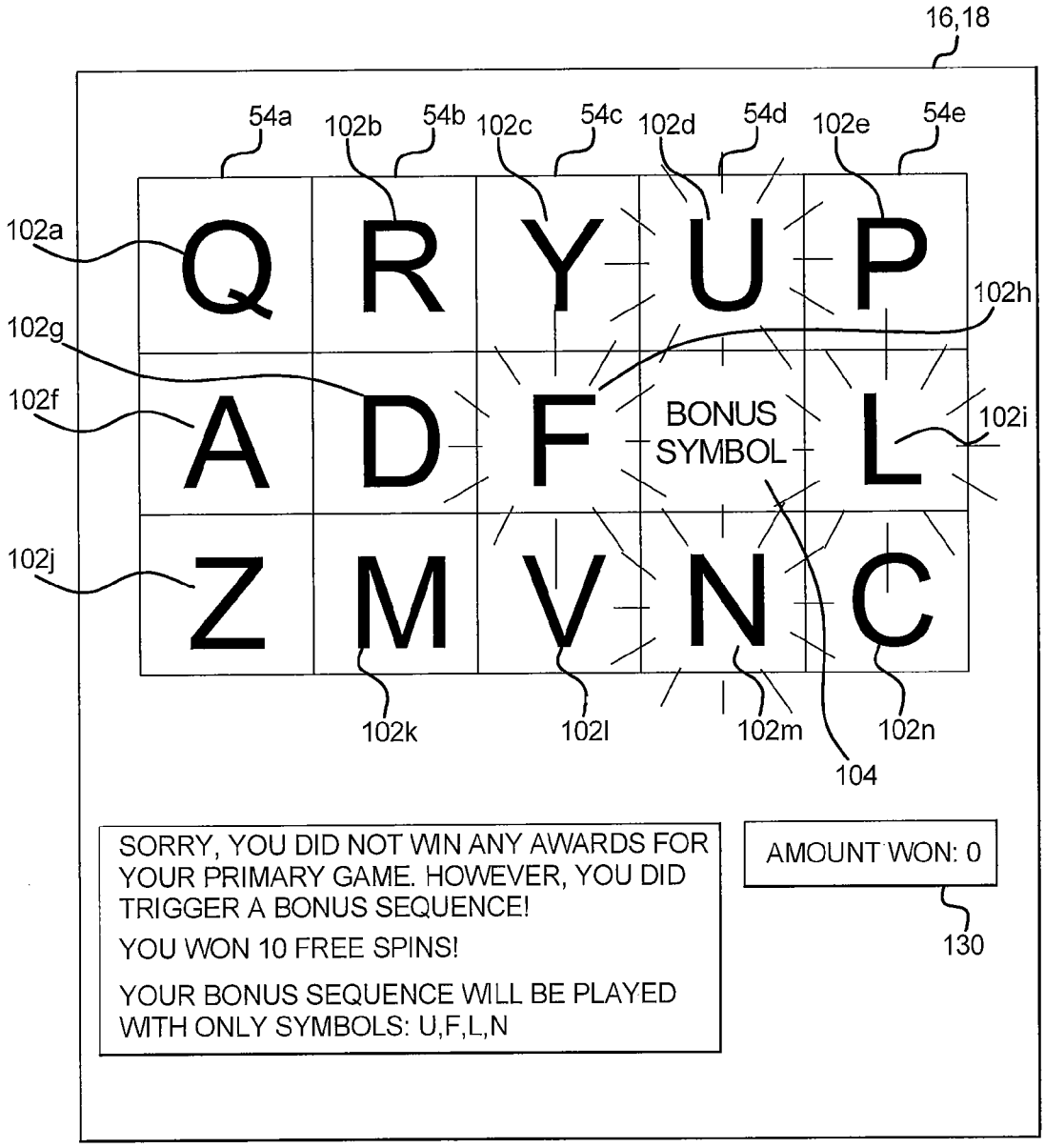
FIGS. 4A, 4B, and 4C are front perspective views of one embodiment of the gaming system disclosed herein illustrating a designated symbol, the symbols of a formed second set of symbols, and a free spins bonus sequence.

If the displayed plurality of symbols from the set of symbols form any winning symbol combinations, the gaming system provides the player an award associated with the formed winning symbol combination, as indicated by block 106. For example, as seen in FIG. 4A, the gaming system displays symbols 102*a* to 102*n* from a set of symbols on reels 54*a*, 54*b*, 54*c*, 54*d*, and 54*e*. In this example, the gaming system determines that no winning symbol combinations are displayed and does not provide any awards to the player as indicated by a 0 displayed in award indicator box 130. In this example, the gaming system displays appropriate messages such as "SORRY, YOU DID NOT WIN ANY AWARDS FOR YOUR PRIMARY GAME" to the player visually, or through suitable audio or audiovisual displays.

After the gaming system determines if any winning symbol combinations from the set of symbols are displayed, the gaming system determines if a designated symbol from the set of symbols is displayed as indicated by diamond 108 of FIG. 3. In one embodiment, if no designated symbol is displayed, the primary game ends and the gaming system enables the player to place a wager and play another primary game as described above and indicated in block 102. On the other hand, if a designated symbol is displayed, the gaming system triggers a bonus sequence and determines the number of bonus symbol generations or free spins available to the player for the triggered bonus sequence as indicated by block 110. For example, as seen in FIG. 4A, the gaming system determines that bonus symbol 104 is displayed on reel 54*d*, and triggers a bonus sequence in which ten free spins are available to the player. In this example, the gaming system displays appropriate messages such as "HOWEVER, YOU DID TRIGGER A BONUS SEQUENCE!" and "YOU WON 10 FREE SPINS!" to the player visually, or through suitable audio or audiovisual displays.

After triggering the bonus sequence, the gaming system determines which symbols are displayed adjacent to the displayed designated symbol as illustrated by block 112 of FIG. 3. For example, as seen in FIG. 4A, the gaming system determines that symbols 102*d*, 102*h*, 102*i*, and 102*m* are displayed directly adjacent to displayed bonus symbol 104. In this example, the gaming system highlights symbols 102*d*, 102*h*, 102*i*, and 102*m* as an indication that such symbols are displayed directly adjacent to bonus symbol 104. The gaming system then forms a sub-set of symbols for the play of the bonus sequence, as indicated by block 114 of FIG. 3. For example, as seen in FIG. 4A, after determining which symbols are displayed directly adjacent to bonus symbol 104, the gaming system determines the sub-set of symbols, wherein the sub-set of symbols only includes symbols 102*d*, 102*h*, 102*i*, and 102*m*. In this example, the gaming system displays appropriate messages such as "YOUR BONUS SEQUENCE WILL BE PLAYED WITH ONLY SYMBOLS: U, F, L, N" to the player visually, or through suitable audio or audiovisual displays. In this example, by providing a bonus sequence with a reduced number of symbols, the gaming system provides a player with an increased probability of receiving a winning symbol combination for each symbol generation in the bonus sequence. It should be appreciated that, in this illustrated example, symbols Q, R, P, A, D, Z, M, V, C, and any other symbols available in the primary game that were not displayed are not included in the sub-set of symbols.

After forming the sub-set of symbols, the gaming system generates and displays a plurality of symbols from the formed sub-set of symbols, as indicated by block 116 of FIG. 3. The gaming system then determines if any winning symbol combinations are displayed as indicated by diamond 118. In one embodiment, the gaming system provides the player any award for any displayed winning symbol combination as indicated by block 120. In this embodiment, after the gaming system provides the player with any award for any displayed winning symbol combination, or if the gaming system did not display a winning symbol combination as indicated by block 118, the gaming system determines if the player has at least one remaining bonus symbol generation as indicated by diamond 122.

Figure 4B:
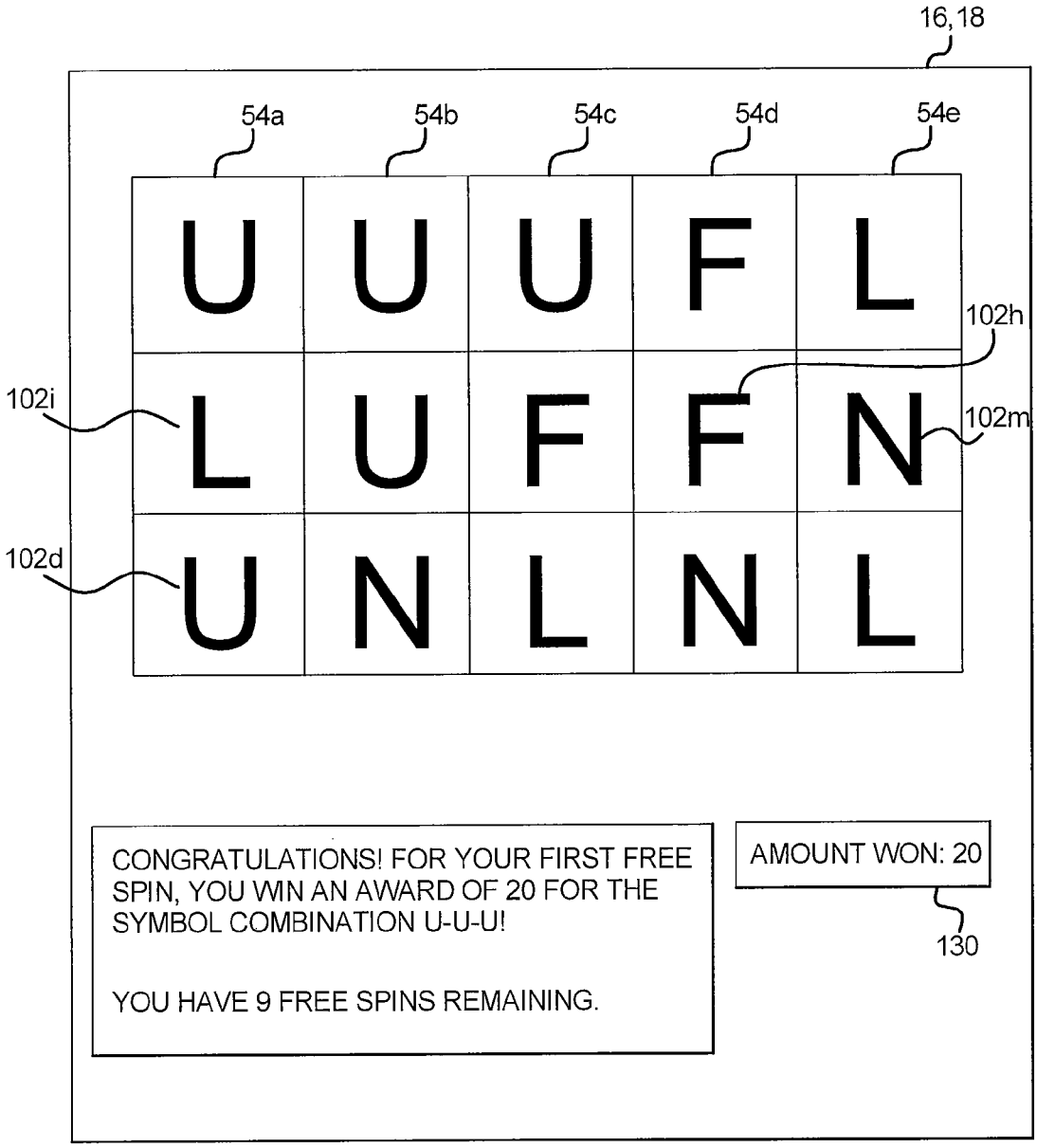

If the gaming system determines that the player has at least one bonus symbol generation remaining, the gaming system continues to generate and display symbols from the sub-set of symbols and provide any awards for any displayed winning symbol combinations for each of the remaining bonus symbol generation. For example, as seen in FIG. 4B, after determining the sub-set of symbols, the gaming system generates and displays symbols 102*d*, 102*h*, 102*i*, and 102*m* from the sub-set of symbols on reels 54*a*, 54*b*, 54*c*, 54*d*, and 54*e*, wherein a winning symbol combination of U-U-U is generated and displayed. The gaming system subsequently provides the player with an award of 20 as indicated in award display box 130 for this winning symbol combination. In this example, the gaming system displays appropriate messages such as "CONGRATULATIONS! FOR YOUR FIRST FREE SPIN, YOU WIN AN AWARD OF 20 FOR THE SYMBOL COMBINATION U-U-U!" and "YOU HAVE 9 FREE SPINS REMAINING!" to the player visually, or through suitable audio or audiovisual displays.

Figure 4C:
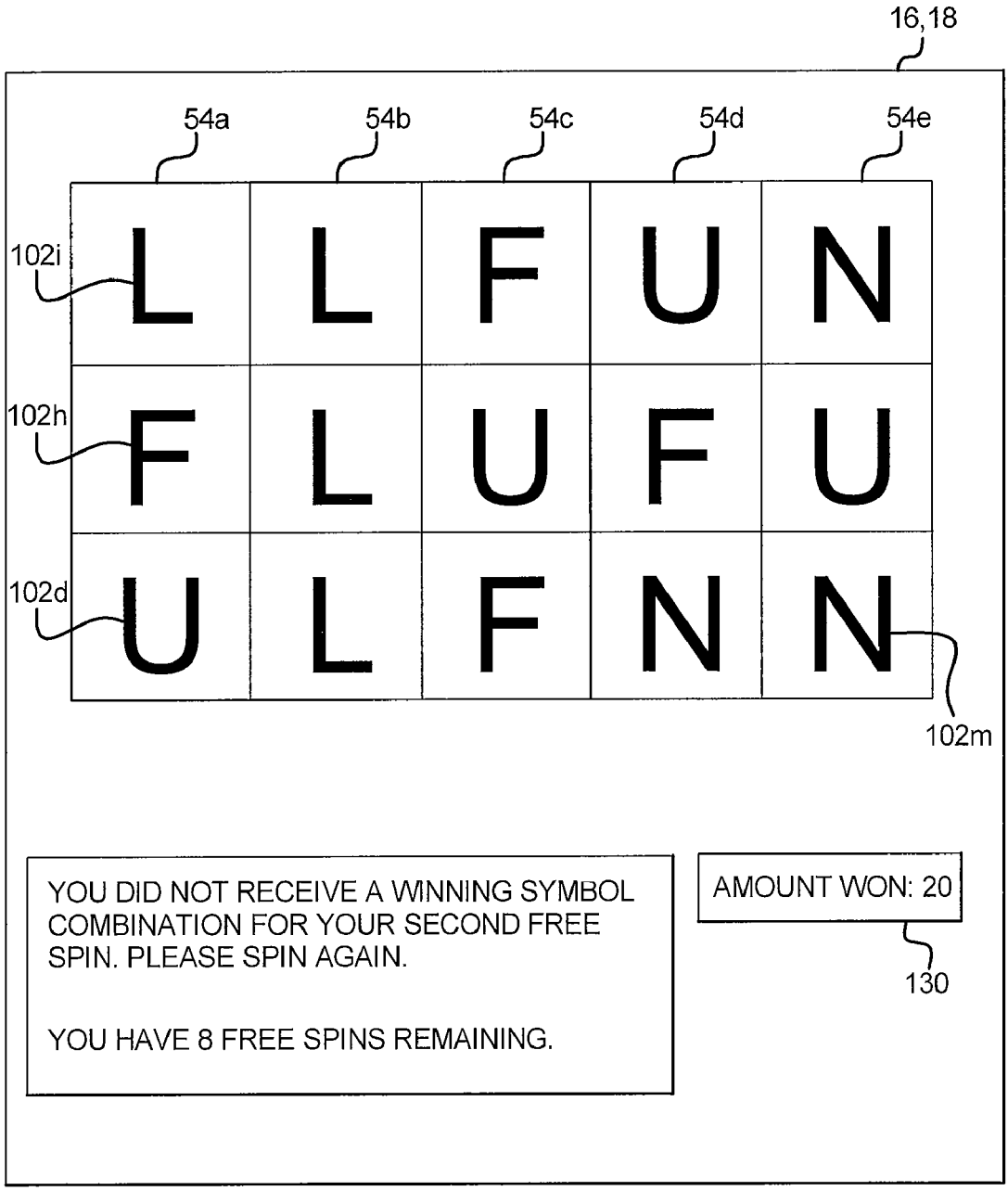

Accordingly, since the player has at least one free spin remaining, the gaming system generates and displays symbols 102*d*, 102*h*, 102*i*, and 102*m* from the sub-set of symbols on reels 54*a*, 54*b*, 54*c*, 54*d*, 54*e* for a subsequent free spin of the bonus sequence as seen in FIG. 4C. As described above, after generating and displaying symbols from the sub-set of symbols, the gaming system determines if any winning symbol combinations are displayed and provides any awards for any such winning combinations to the player. In this example, no winning symbol combinations are displayed. Accordingly, the gaming does not provide the player any award for this free spin and displays appropriate messages such as "YOU DID NOT RECEIVE A WINNING SYMBOL COMBINATION FOR YOUR SECOND FREE SPIN. PLEASE SPIN AGAIN." and "YOU HAVE 8 FREE SPINS REMAINING!" to the player visually, or through suitable audio or audiovisual displays.

In one embodiment, the gaming system continues to generate symbols from the sub-set of symbols, determine if any winning symbol combinations are displayed, and provide the player with any awards for winning symbol combinations until no free spins remain available to the player. In the example illustrated in FIG. 4A to FIG. 4C, the gaming system is generating and displaying symbols from a sub-set of symbols which includes only four different symbols during each play of the bonus sequence. This makes the bonus sequence desirable for a player, as such a bonus sequence provides the player with a higher probability of receiving a winning combination relative to the primary game.

In one embodiment, after the gaming system determines that no free spins remain in the bonus sequence, the bonus sequence ends and the gaming system enables the player to place a wager and play another primary game as described above and indicated in block 102 of FIG. 3. FIG. 5 illustrates the award associated with each free spin of this example of the bonus sequence. As seen in FIG. 5, when the bonus sequence ends, the gaming system provides the player with a total award, wherein the total award is the accumulation of the award provided for each of the free spins of the bonus sequence. In this example, the gaming system provides the player with a total award of eighty-five for the ten free spins of the bonus sequence.

Figure 6:
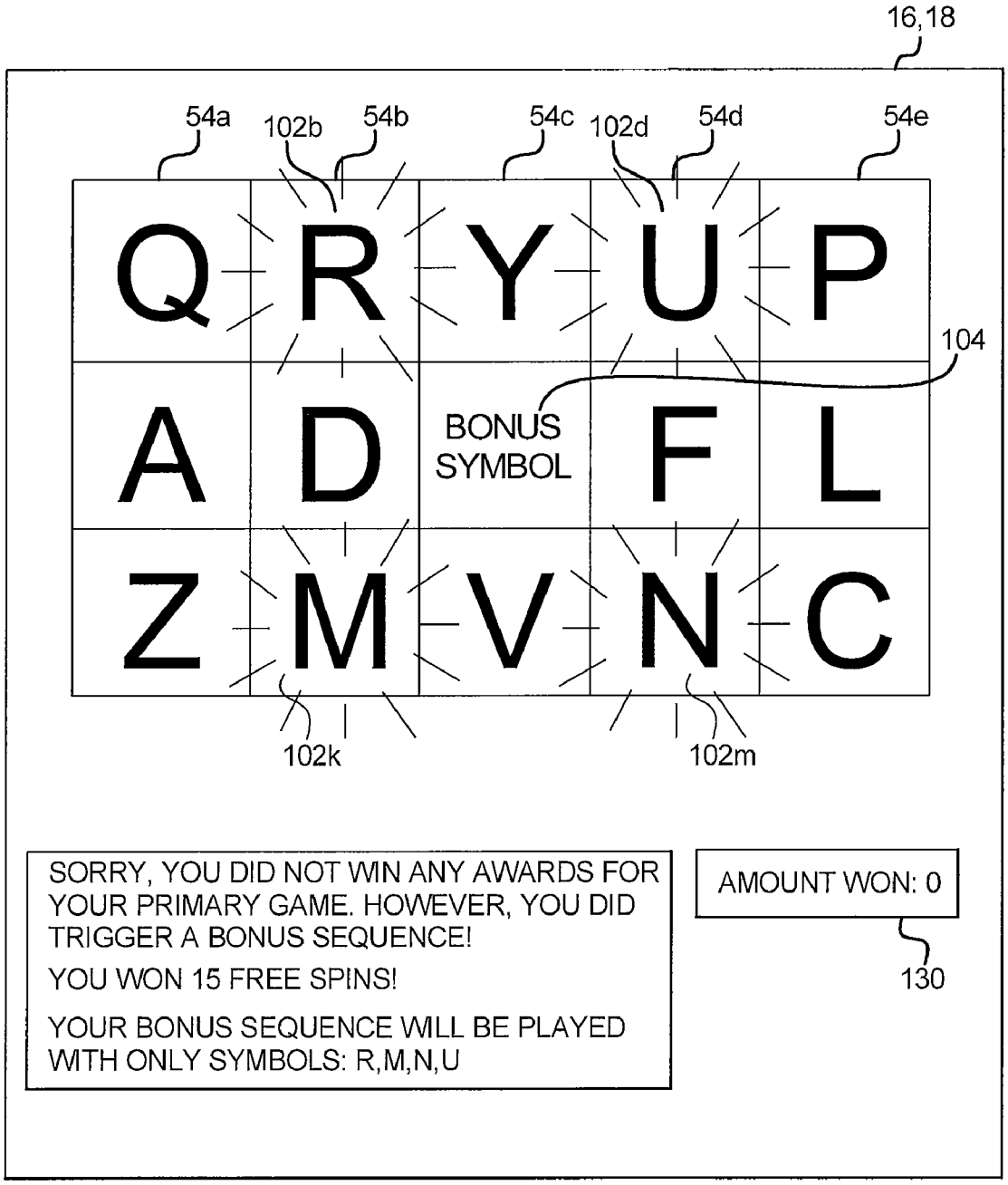
FIG. 6 is a front perspective view of an alternative embodiment of the gaming device disclosed herein wherein the symbols included in a formed second set of symbols are displayed indirectly adjacent to a displayed designated symbol.

In another embodiment, if a designated symbol is displayed, the gaming system determines which symbols are displayed indirectly adjacent to the displayed designated symbol and includes only these symbols in the sub-set of symbols. That is, the gaming system determines which symbols are displayed in symbol positions that are diagonal positions relative to the displayed designated symbol. For example, as seen in FIG. 6, after determining that bonus symbol 104 is displayed on reel 54*c*, the gaming system determines that symbols 102*b*, 102*d*, 102*k*, and 102*m* are displayed indirectly adjacent to bonus symbol 104. In this example, the gaming system highlights symbols 102*b*, 102*d*, 102*k*, and 102*m* as an indication that such symbols are displayed indirectly adjacent to bonus symbol 104. Accordingly, in this example, the sub-set of symbols only includes symbols 102*b*, 102*d*, 102*k*, and 102*m*. Thus, the bonus sequence will only generate and display symbols from this sub-set of symbols for the bonus sequence. For example, as seen in FIG. 6, the gaming system displays appropriate messages such as "SORRY, YOU DID NOT WIN ANY AWARDS FOR YOUR PRIMARY GAME. HOWEVER, YOU DID TRIGGER A BONUS SEQUENCE!" and "YOU WON 15 FREE SPINS!" and "YOUR BONUS SEQUENCE WILL BE PLAYED WITH ONLY SYMBOLS: R, M, N, U" to the player visually, or through suitable audio or audiovisual displays. It should be appreciated that, in this illustrated example, symbols Q, Y, P, A, D, F, L, Z, V, C, and any other symbols available in the primary game that were not displayed are not included in the sub-set of symbols.

Figure 7:
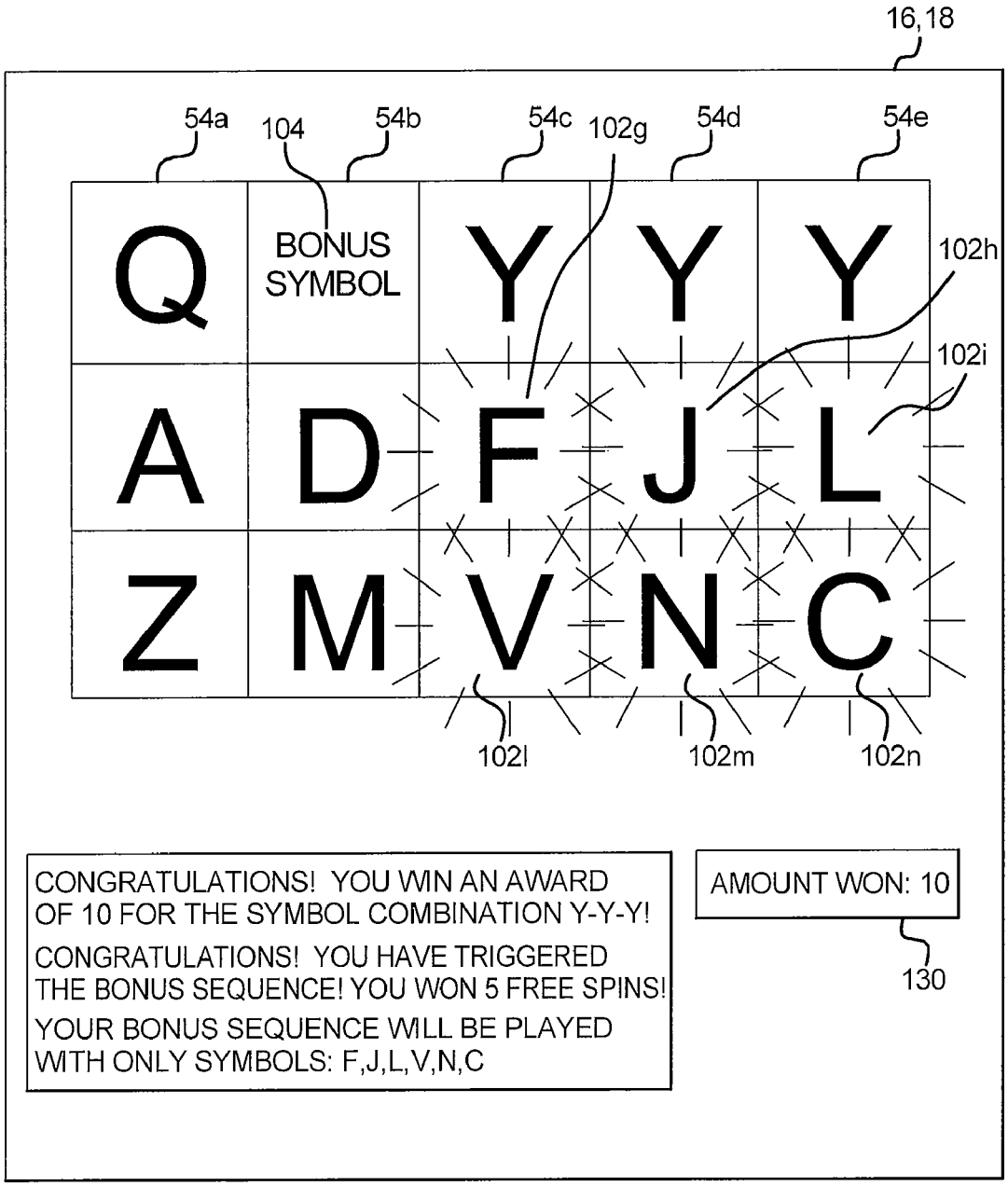
FIG. 7 is a front perspective view of an alternative embodiment of the gaming device disclosed herein wherein the symbols included in a formed second set of symbols are displayed in symbol position locations relative to or having a predetermined relationship to the symbol position location of the designated symbol.

In another embodiment, if a designated symbol is displayed during a play of the primary game, the gaming system determines which symbols are displayed in symbol position locations relative to or having a predetermined relationship to the symbol position location of the displayed designated symbol and includes only these symbols in the sub-set of symbols. For example, as seen in FIG. 7, after providing an award of 10 for a displayed winning symbol combination of Y-Y-Y, and determining that bonus symbol 104 is displayed on reel 54*b*, the gaming system determines that symbols 102*g*, 102*h*, 102*i*, 102*l*, 102*m*, and 102*n* are displayed in symbol position locations having a predetermined relationship to the symbol position location of the displayed bonus symbol 104. In this example, the gaming system highlights symbols 102*g*, 102*h*, 102*i*, 102*l*, 102*m*, and 102*n* as an indication that such symbols are displayed in symbol position locations having a predetermined relationship to the symbol position location of the displayed bonus symbol 104. Accordingly, in this example, the sub-set of symbols only includes symbols 102*g*, 102*h*, 102*i*, 102*l*, 102*m*, and 102*n*. Thus, the gaming system will only generate and display symbols from this sub-set of symbols for the bonus sequence. For example, as seen in FIG. 7, the gaming system displays appropriate messages such as "CONGRATULATIONS! YOU WIN AN AWARD OF 10 FOR THE SYMBOL COMBINATION Y-Y-Y!" and "CONGRATULATIONS! YOU HAVE TRIGGERED THE BONUS SEQUENCE! YOU WON 5 FREE SPINS!" and "YOUR BONUS SEQUENCE WILL BE PLAYED WITH ONLY SYMBOLS: F, J, L, V, N, C" to the player visually, or through suitable audio or audiovisual displays. It should be appreciated that, in this illustrated example, symbols Q, Y, A, D, Z, M, and any other symbols available in the primary game that were not displayed are not included in the sub-set of symbols.

Figure 8:
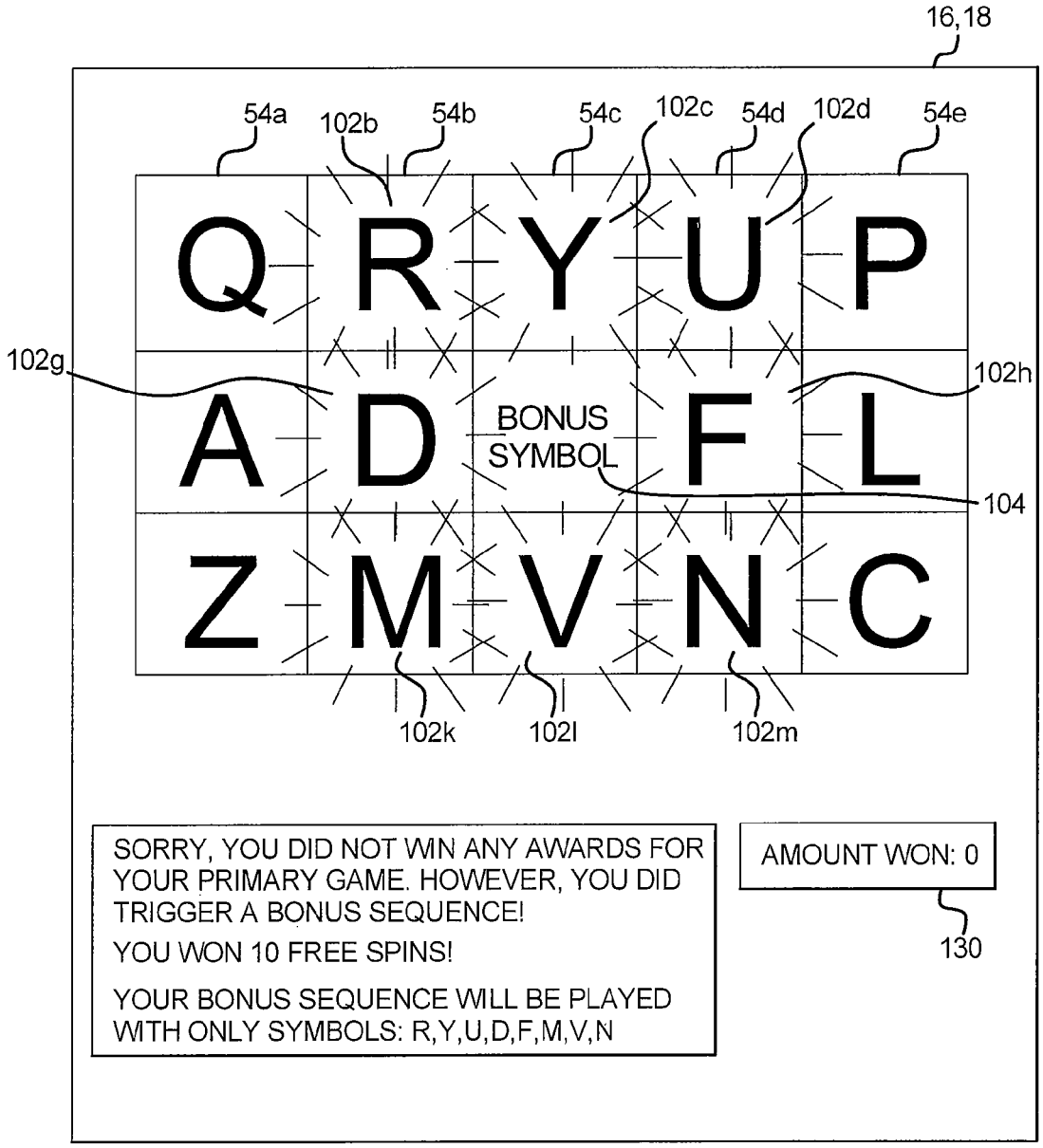
FIG. 8 front perspective view of an alternative embodiment of the gaming device disclosed herein wherein the symbols included in a formed second set of symbols are displayed directly adjacent to the displayed designated symbol and displayed indirectly adjacent to the displayed designated symbol.

In another embodiment, if a designated symbol is displayed in the primary game, the gaming system determines which symbols are displayed directly adjacent to the displayed designated symbol, and which symbols are displayed indirectly adjacent to the displayed designated symbol, and includes only these symbols in the sub-set of symbols. For example, as seen in FIG. 8, after determining that bonus symbol 104 is displayed on reel 54*c*, the gaming system determines that symbols 102*c*, 102*g*, 102*h*, and 102*l* are displayed directly adjacent to the displayed bonus symbol 104, and symbols 102*b*, 102*d*, 102*k*, and 102*m* are displayed indirectly adjacent to the displayed bonus symbol 104. In this example, the gaming system highlights symbols 102*b*, 102*c*, 102*d*, 102*g*, 102*h*, 102*k*, 102*l*, and 102*m* as an indication that such symbols are displayed directly adjacent and indirectly adjacent to the displayed bonus symbol 104. Accordingly, in this example, the sub-set of symbols includes only symbols 102*b*, 102*c*, 102*d*, 102*g*, 102*h*, 102*k*, 102*l*, and 102*m*. Thus, in this example, the gaming system will only generate and display symbols from this sub-set of symbols for the bonus sequence. For example, as seen in FIG. 8, the gaming system displays appropriate messages such as "SORRY, YOU DID NOT WIN ANY AWARDS FOR YOUR PRIMARY GAME. HOWEVER, YOU DID TRIGGER A BONUS SEQUENCE!" and "YOU WON 10 FREE SPINS!" and "YOUR BONUS SEQUENCE WILL BE PLAYED WITH ONLY SYMBOLS: R, Y, U, D, F, M, V, N" to the player visually, or through suitable audio or audiovisual displays. It should be appreciated that, in this illustrated example, symbols Q, P, A, L, Z, C, and any other symbols available in the primary game that were not displayed are not included in the sub-set of symbols.

In various embodiments, as different symbols will be randomly generated and displayed adjacent to the designated symbol for different plays of a primary game, the gaming system disclosed herein is configured to provide different bonus sequences that utilize different quantities of symbols. Such a configuration provides that different bonus sequences that utilize different sub-sets of symbols which include different quantities of a first symbol are associated with different probabilities of generating a winning symbol combination associated with that first symbol. For example, a first bonus sequence includes a sub-set of five bar symbols and five cherry symbols, and a second bonus sequence includes a sub-set of eight bar symbols and two cherry symbols. In this example, while both bonus sequences utilize sub-sets which include only bar symbols and cherry symbols in addition to any blank symbols, the quantity of bar symbols and cherry symbols is different in the first bonus sequence relative to the second bonus sequence. Thus, the probability of generating a winning bar symbol combination in the first bonus sequence is less than the probability of generating a winning bar symbol combination in the second bonus sequence. Similarly, the probability of generating a winning cherry symbol combination in the first bonus sequence is greater than the probability of generating a winning cherry symbol combination in the second bonus sequence.

In another embodiment, one or more symbols are included in the formed sub-set of symbols by default. That is, such bonus sequence default symbols, such as one or more wild symbols or one or more multiplier symbols, are available to be displayed in each bonus sequence in addition to the symbols the gaming system determines to be displayed in symbol position locations relative to or having a predetermined relationship to a displayed designated symbol (and thus includes these bonus sequence default symbols in each sub-set of symbols). In one embodiment, the bonus sequence default symbols remain the same for each play of each triggered bonus sequence (i.e., the bonus sequence default symbols do not change). In another embodiment, the bonus sequence default symbols are different for each bonus sequence (i.e., the bonus sequence default symbols change for subsequent bonus sequences). In one embodiment, the bonus sequence default symbols are symbols that are available to be displayed in the primary game. In another embodiment, the bonus sequence default symbols are symbols that are not available to be displayed in the primary game. That is, in this embodiment, the symbols included in the sub-set of symbols are only available to be displayed in the bonus sequence. In different embodiments, the bonus sequence default symbols are predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

The gaming system disclosed herein is further configured to provide different bonus sequences associated with different average expected payouts. That is, if a first bonus sequence utilizes a first quantity of a first symbol, then a winning symbol combination including this first symbol has a first probability of being generated in the first bonus sequence. If this first symbol winning combination is associated with a first award amount, then this first bonus sequence has a first average expected payout. Similarly, if a second bonus sequence utilizes the first quantity of a second, different symbol, then a winning symbol combination which includes this second symbol has the first probability of being generated in this second bonus sequence. If this second symbol winning combination is associated with a second, different award amount, then this second bonus sequence has a second, different average expected payout. For example, a first bonus sequence includes a sub-set of two bar symbols and eight cherry symbols, and a second bonus sequence includes a sub-set of eight bar symbols and two cherry symbols, wherein winning cherry symbol combinations are associated with a higher award amount than winning bar symbol combinations. In this example, because the probability of generating a winning cherry symbol combination in the first bonus sequence is equal to the probability of generating a winning bar symbol combination in the second bonus sequence and winning cherry symbol combinations are associated with higher award values than winning bar symbol combinations, the first bonus sequence has a higher average expected payout than the second bonus sequence.

In different embodiments, the quantity of designated symbols in the set of symbols of the primary game is predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

In one embodiment, the gaming system enables the player to designate at least one symbol as the designated symbol prior to playing the primary game. In another embodiment, the gaming system enables the player to designate a plurality of symbols as designated symbols prior to playing the primary game.

In one embodiment, the gaming system triggers the bonus sequence if one of the designated symbols is generated and displayed during a play of the primary game. In another embodiment, the gaming system triggers the bonus sequence if a plurality of designated symbols are generated and displayed during a play of the primary game. In different embodiments, the determination of the quantity of designated symbols needed to be generated during a play of the primary game to trigger the bonus sequence is predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

In one embodiment, a bonus sequence triggering event occurs based on an amount coin-in. In this embodiment, the gaming system determines if an amount of coin-in wagered at one or more gaming devices in the gaming system reaches or exceeds a designated amount of coin-in (i.e., a threshold coin-in amount). Upon the amount of coin-in wagered at one or more gaming devices in the gaming system reaching or exceeding the bonus threshold coin-in amount, the gaming system causes the bonus sequence triggering event to occur. In different embodiments, the threshold coin-in amount is predetermined, randomly determined, determined based on a player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day) or determined based on any other suitable method or criteria.

In another embodiment of the gaming system disclosed herein, a bonus sequence triggering event occurs based on an amount coin-out. In this embodiment, the gaming system determines if an amount of coin-out provided by one or more gaming devices in the gaming system reaches or exceeds a designated amount of coin-out (i.e., a threshold coin-out amount). Upon the amount of coin-out provided at one or more gaming devices in the gaming system reaching or exceeding the threshold coin-out amount, the gaming system causes the bonus sequence triggering event to occur. In different embodiments, the threshold coin-out amount is predetermined, randomly determined, determined based on a player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day) or determined based on any other suitable method or criteria.

In another embodiment of the gaming system disclosed herein, a bonus sequence triggering event occurs based on a predefined variable reaching a defined parameter threshold. For example, when the $500{,}000^{th}$ player has played a gaming machine of the gaming system (ascertained from a player tracking system), the bonus sequence triggering event occurs. In different embodiments, the predefined parameter thresholds include a length of time, a length of time after a certain dollar amount is hit, a wager level threshold for a specific machine (which gaming device is the first to contribute $250,000), a number of gaming machines active, or any other parameter that defines a suitable threshold.

In another embodiment of the gaming system disclosed herein, a bonus sequence triggering event occurs based on time. In this embodiment, a time is set for when the bonus sequence triggering event will occur. In one embodiment, such a set time is based on historic data.

In another embodiment of the gaming system disclosed herein, a bonus sequence triggering event occurs based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the central controller/gaming device processor recognizes the player's identification (via the player tracking system) when the player inserts or otherwise associates their player tracking card in the gaming machine. The central server/gaming device processor determines the player tracking level of the player and if the current player tracking level defined by the gaming system operator is eligible for the bonus sequence triggering event. In one embodiment, the gaming system operator defines minimum bet levels required for bonus sequence triggering events to occur based on the player's card level.

In another embodiment of the gaming system disclosed herein, a bonus sequence triggering event occurs based on a system determination, including one or more random selections by the central controller. In one embodiment, as described above, the central controller tracks all active gaming machines and the wagers they placed. Each gaming machine has its own entry defining its state as either active or inactive and also defining the values of the wagers from that gaming machine. In one embodiment, active status means that the gaming machine is being actively played by a player and enrolled/inactive status means that the gaming machine is not being actively played by a player. The active status requirements can be based on any suitable number of satisfied criteria or defined in any suitable manner by the implementer of the gaming system. In one such embodiment, based on the gaming machine's state as well as one or more wager pools associated with the gaming machine, the central controller determines whether the bonus sequence triggering event will occur. In one such embodiment, the player who consistently places a higher wager is more likely to be associated with an occurrence of the bonus sequence triggering event than a player who consistently places a minimum wager. It should be appreciated that the criteria for determining whether a player is in active status or inactive status for determining if the bonus sequence triggering event will occur may be the same as, substantially the same as, or different than the criteria for determining whether a player is in active status or inactive status for another bonus sequence triggering event to occur.

In another embodiment of the gaming system disclosed herein, a bonus event triggering condition occurs based on a determination of if any numbers allotted to a gaming device match a randomly selected number. In this embodiment, upon or prior to each play of each gaming machine, a gaming device selects a random number from a range of numbers and during each primary game, the gaming machine allocates the first N numbers in the range, where N is the number of credits bet by the player in that primary game. At the end of the primary game, the randomly selected number is compared with the numbers allocated to the player and if a match occurs, the bonus sequence triggering event will occur. It should be appreciated that any suitable manner of causing the bonus sequence triggering event to be provided may be implemented in accordance with the gaming system and method disclosed herein.

In another embodiment, a bonus sequence triggering event occurs independent of any displayed event in any play of any game of any of the gaming devices in the gaming system. That is, the bonus sequence is based on a trigger that is unknown to the player (i.e., a mystery trigger). In another embodiment, the gaming system tracks the occurrences of one or more suitable events occurring at or in association with one or more players and/or one or more gaming devices in the gaming system and determines, based on these tracked events, whether a bonus sequence triggering event has occurred. In another embodiment, the gaming system defines one or more game play parameters, wherein each time a player's tracked game play activity satisfies the defined parameter, the bonus sequence triggering event occurs.

In one embodiment, if a mystery bonus sequence triggering event occurs, the gaming system utilizes a table (or chart) to determine a quantity of symbols to utilize in the triggered bonus sequence. In one embodiment, this table includes a plurality of different quantities of symbols, wherein each quantity of symbols is associated with a probability of being randomly selected to be utilized in the triggered bonus sequence. In one such embodiment, the gaming system also utilizes a table (or chart) to determine which symbols to include in the determined quantity of symbols. In one embodiment, this table includes a plurality of different symbols, wherein each symbol is associated with a probability of being randomly selected to be included in the determined quantity of symbols utilized in the triggered bonus sequence.

In one embodiment, after the gaming system determines a quantity of symbols to utilize in the triggered bonus sequence, the gaming system randomly determines a designated quantity of randomly determined symbols for the quantity of symbols. In one such embodiment, for each of the designated quantity of randomly determined symbols, if the randomly determined symbol is not a symbol that was displayed in association with the primary game in which the mystery triggering event occurred, the gaming system does not include this randomly determined symbol in the quantity of symbols. Rather, the gaming system randomly determines another symbol and determines if this randomly determined symbol was displayed in association with the primary game in which the mystery triggering event occurred. The gaming system repeats the above mentioned random determination until the gaming system randomly determines a symbol that was displayed in association with the primary game in which the mystery triggering event occurred. The gaming system continues to include these randomly determined symbols in the quantity of symbols until the quantity of symbols includes the determined designated quantity of symbols.

In one embodiment, if a plurality of designated symbols are generated and displayed during a play of the primary game, the gaming system enables the player to pick or select a designated symbol from the plurality of displayed designated symbols. In another embodiment, the gaming system picks or selects a designated symbol from a plurality of displayed designated symbols. In this embodiment, the gaming system determines the sub-set of symbols, wherein the sub-set of symbols includes only symbols that are displayed in symbol position locations relative to or having a predetermined relationship to the symbol position location of the selected designated symbol. In another embodiment, if a plurality of designated symbols are generated and displayed, the gaming system enables the player to play a bonus sequence for each of the displayed designated symbols. In one embodiment, the gaming system determines a plurality of sub-sets of symbols and associates a different number of free spins with each formed sub-set of symbols.

In one embodiment, after the gaming system determines that a designated symbol is displayed during a play of the primary game, the gaming system triggers a bonus sequence and determines the number of free spins available to the player for the bonus sequence. In one embodiment, the number of free spins available to the player during a play of the bonus sequence is predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

In one embodiment, the gaming system determines the quantity of symbols to include in the sub-set of symbols. That is, the gaming system determines a quantity of symbols that are determined to be displayed in symbol positions relative to or having a predetermined relationship to the symbol position location of the designated symbol, and are to be included in the sub-set of symbols. In different embodiments, the number of symbols the gaming system determines to be displayed in symbol position locations having a predetermined relationship to the symbol position location of the designated symbol is predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

In another embodiment, after determining which symbols to include in the sub-set of symbols for the bonus sequence, the gaming system determines the quantity of each symbol to include in the sub-set. In one such embodiment, for one or more symbols in the sub-set, the quantity of that symbol being available for the bonus sequence is the same as the quantity of that symbol being available for the primary game. In another embodiment, for one or more symbols in the sub-set, the quantity of that symbol being available for the bonus sequence is different than the quantity of that symbol being available for the primary game. In different embodiments, for one or more symbols included in the sub-set of symbols for a bonus sequence, the quantity of that symbol in the sub-set is predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

In one embodiment, after determining which symbols to include in the sub-set of symbols and the quantity associated with each symbol included in the determined sub-set of symbols, the gaming system eliminates or removes any symbols displayed in the primary game that are not included in the determined sub-set of symbols. In one such embodiment, the gaming system replaces each of the symbols displayed in the primary game that are not included in the determined sub-set of symbols with symbols from the determined sub-set of symbols. In another such embodiment, the gaming system first replaces each of the symbols displayed in the primary game that are not included in the determined sub-set of symbols with a blank symbol. In this embodiment, the gaming system then replaces each blank symbol with a symbol from the determined sub-set of symbols. After displaying such symbols from the determined sub-set of symbols, the gaming system determines any awards for any displayed winning symbol combinations as described herein.

In another embodiment, after determining which symbols to include in the sub-set of symbols and the quantity associated with each symbol included in the determined sub-set of symbols, the gaming system generates and displays a plurality of symbols. In this embodiment, the gaming system then removes any of the generated and displayed symbols that are not included in the determined sub-set of symbols. In one such embodiment, the gaming system replaces each of the displayed symbols that are not included in the determined sub-set of symbols with symbols that are included in the determined sub-set of symbols. In another such embodiment, the gaming system first replaces each of the displayed symbols that are not included in the determined sub-set of symbols with a blank symbol. In this embodiment, the gaming system then replaces each blank symbol with a symbol from the determined sub-set of symbols. After displaying such symbols from the determined sub-set of symbols, the gaming system determines any awards as described herein.

In one embodiment, the gaming system includes blank symbols in the sub-set of symbols utilized in a bonus sequence. In other words, if a designated symbol is generated and displayed during a play of the primary game and one or more blank symbols are displayed in symbol position locations relative to or having a predetermined relationship to the symbol position location of a displayed designated symbol, the gaming system includes each of these blank symbols in the sub-set of symbols to be utilized in the bonus sequence. In one such embodiment, the gaming system associates each of the blank symbols included in the sub-set of symbols with a non-blank symbol, such that if one or more blank symbols from the sub-set of symbols are displayed during a play of the bonus sequence, the gaming system interprets each displayed blank symbol as this associated non-blank symbol and provides any awards for any winning outcomes accordingly.

In one such embodiment, the gaming system associates each blank symbol with a symbol from the sub-set of symbols. For example, if the sub-set of symbols includes bar symbols, cherry symbols, bell symbols, and blank symbols, the gaming system associates each of the blank symbols in the sub-set of symbols with either a bar symbol, a cherry symbol, or a bell symbol. In this example, if the gaming system associates a blank symbol in the sub-set of symbols with a cherry symbol, the gaming system interprets this blank symbol displayed in the bonus sequence as a cherry symbol and provides any awards for any winning outcomes. Thus, in this example, if a cherry-cherry-blank symbol combination is displayed in the bonus sequence, and a cherry-cherry-cherry symbol combination is a designated winning outcome, the gaming system provides the player an award for the cherry-cherry-blank symbol combination because the blank symbol in this symbol combination is interpreted as a cherry symbol.

In another embodiment, the gaming system associates each blank symbol in the sub-set of symbols with one of the symbols from the plurality of symbols that is displayed in the primary game. In another embodiment, the gaming system associates each blank symbol in the sub-set of symbols with a symbol from the plurality of symbols available in the primary game. In different embodiments, the symbol that the gaming system associates with each blank symbol in the sub-set of symbols is predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

In one embodiment, if a designated symbol is generated and displayed in a play of the primary game and one or more blank symbols are displayed in symbol position locations having a predetermined relationship to the symbol position location of a displayed designated symbol, the gaming system determines a symbol to include in the sub-set of symbols in place of each of these displayed blank symbols. That is, the gaming system determines another symbol (i.e., a non-blank symbol) to include in the sub-set of symbols in place of each blank symbol displayed in a symbol position location relative to or having a predetermined relationship to the symbol position location of the displayed designated symbol.

In one embodiment, the symbol that the gaming system determines to include in the sub-set of symbols in place of these blank symbols is a symbol from the plurality of symbols displayed in the primary game. In another embodiment, the symbol that the gaming system determines to include in the sub-set of symbols in place of these blank symbols is a symbol from the plurality of symbols available in the primary game. In different embodiments, the symbol that the gaming system determines to include in the sub-set of symbols in place of these blank symbols is predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

In one embodiment, if a plurality of designated symbols are generated and displayed during a play of the primary game, the gaming system determines a sub-set of symbols, wherein the sub-set of symbols includes only the symbols displayed adjacent to each of the displayed designated symbols. In one embodiment, the sub-set of symbols includes the symbols displayed directly adjacent to each of the displayed designated symbols. In another embodiment, the sub-set of symbols includes the symbols displayed indirectly adjacent to each of the displayed designated symbols. In another embodiment, the sub-set of symbols includes the symbols displayed in symbol position locations relative to or having a predetermined relationship to the symbol position location of each of the displayed designated symbols.

In one embodiment, if a plurality of designated symbols are generated and displayed, the gaming system includes different determinations of which symbols to include in a sub-set of symbols for each of, or a plurality of the generated designated symbols. For example, if a plurality of designated symbols are generated and displayed during a play of the primary game, the gaming system makes a first determination of which symbols are displayed directly adjacent to a first one of the designated symbols. In this embodiment, the gaming system then makes a second determination of which symbols are displayed indirectly adjacent to a second one of the designated symbols. The gaming system then determines a sub-set of symbols, wherein the sub-set includes only the symbols from the first determination (i.e., symbols displays directly adjacent to the displayed designated symbol) and the symbols from the second determination (i.e., symbols displayed indirectly adjacent to the displayed designated symbol).

In one embodiment, the gaming system enables the player to select the type of determination made to form the sub-set of symbols, wherein the determination is whether to select symbols displayed in symbol position locations relative to or having a predetermined relationship to the symbol position location of the designated symbol, displayed directly adjacent to the designated symbol, displayed indirectly adjacent to the designated symbol, or any combination of these determinations.

In one embodiment, the gaming system associates each symbol in a sub-set of symbols utilized in a bonus sequence with a probability of being generated in that bonus sequence. In one such embodiment, for a bonus sequence which utilizes a plurality of symbol generators that include one or more symbol positions, the gaming system randomly determines which symbol to associate with each symbol position of each symbol generator based on each symbol's (of the sub-set) probability of being generated in the bonus sequence. It should be appreciated that, in one embodiment, the gaming system associates each symbol in a sub-set of symbols with a different probability of being generated in a bonus sequence.

In one embodiment, if a triggering event occurs and the gaming system forms a sub-set of symbols to utilize in a bonus sequence, as described above, the gaming system associates each symbol available in the formed sub-set of symbols with a probability of being generated in the bonus sequence. In one embodiment, for one or more symbols in the formed sub-set of symbols, the probability of generating that symbol in the bonus sequence is the same as the probability of generating that symbol in the primary game. For example, if a symbol has a first probability of being generated and displayed in a primary game, and a triggering event occurs and that symbol is determined to be in a sub-set of symbols utilized in a bonus sequence, that symbol has the first probability of being generated in the bonus sequence. In another embodiment, for one or more symbols in the formed sub-set of symbols, the probability of generating that symbol in the bonus sequence is different than the probability of generating that symbol in the primary game. For example, if a symbol has a first probability of being generated and displayed in a primary game, and a triggering event occurs and that symbol is determined to be in a sub-set of symbols utilized in a bonus sequence, that symbol has a second, different probability of being generated in the bonus sequence.

In one embodiment, if a triggering event occurs, the gaming system forms a sub-set of symbols to utilize in a bonus sequence, wherein each of the symbols in the sub-set of symbols have the same probability of being displayed during a play of the bonus sequence. For example, a sub-set of symbols utilized in a bonus sequence includes a first symbol and a second symbol, wherein the first symbol and the second symbol have the same probability of being generated in a play of the bonus sequence. In another embodiment, if a triggering event occurs, the gaming device forms a sub-set of symbols for a bonus sequence, wherein each of the symbols in the sub-set of symbols have a different probability of being displayed during a play of the bonus sequence. For example, a sub-set of symbols utilized in a bonus sequence includes a first symbol and a second symbol, wherein the first symbol has a different probability of being generated in a play of the bonus sequence relative to the second symbol. In different embodiments, the probability of each symbol in the sub-set being generated in a play of the bonus sequence is predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

It should be appreciated that, in one embodiment, the sub-set of symbols utilized in a bonus sequence includes one or more designated symbols, such that if a designated symbol is generated and displayed during a play of the bonus sequence or secondary game, the gaming system determines which symbols are displayed in symbol position locations having a predetermined relationship to the symbol position location of the displayed designated symbol in the bonus sequence or secondary game and includes these symbols in another, different sub-set of symbols to be utilized in another, different bonus sequence. In one embodiment, the gaming system designates the symbol positions directly and indirectly adjacent to the displayed designated symbol as the symbol position locations having a predetermined relationship to the symbol position location of a displayed designated symbol in the bonus sequence. In another such embodiment, the gaming system designates the symbol positions directly adjacent to the displayed designated symbol as the symbol position locations having a predetermined relationship to the symbol position location of a displayed designated symbol in the bonus sequence. In another such embodiment, the gaming system designates the symbol positions indirectly adjacent to the displayed designated symbol as the symbol position locations having a predetermined relationship to the symbol position location of a displayed designated symbol.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising: at least one display device; at least one input device; at least one processor; and at least one memory device which stores a plurality of instructions, which when executed by the at least one processor, cause the at least one processor to operate with the at least one display device and the at least one input device to: (a) enable a player to place a wager to play a primary game; (b) generate and display a plurality of symbols from a set of symbols for the play of the primary game, wherein at least one symbol of said set of symbols is a designated symbol; (c) determine if said displayed plurality of symbols from said set of symbols form any of a plurality of winning symbol combinations; (d) if said displayed plurality of symbols from said set of symbols form any of the winning symbol combinations, provide any awards associated with said formed winning symbol combinations; and (e) if said displayed plurality of symbols include said at least one designated symbol: (i) determine which of said displayed plurality of symbols are displayed directly adjacent to said at least one displayed designated symbol; (ii) determine a sub-set of said displayed plurality of symbols, wherein said sub-set of symbols includes said displayed plurality of symbols that are determined to be displayed directly adjacent to said at least one displayed designated symbol, and said sub-set includes fewer than all and not all of said displayed plurality of symbols; (iii) randomly generate and display a plurality of symbols from said sub-set of symbols; (iv) determine if the displayed plurality of symbols from said sub-set of symbols form any of the winning symbol combinations; and (v) if the displayed plurality of symbols from said sub-set of symbols form any of the winning symbol combinations, provide any additional awards associated with said formed winning symbol combinations.

2. The gaming system of claim 1, wherein when executed by the at least one processor, said plurality of instructions cause the at least one processor to operate with the at least one display device to repeat (e)(iii) to (e)(v) at least once.

3. The gaming system of claim 1, wherein the sub-set includes only symbols determined to be displayed directly adjacent to said designated symbol.

4. The gaming system of claim 1, wherein when executed by the at least one processor, said plurality of instructions cause the at least one processor to operate with the at least one display device to enable the player to pick at least one of said symbols displayed directly adjacent to said designated symbol, wherein said sub-set of symbols includes only the symbols the player picked.

5. The gaming system of claim 1, wherein when executed by the at least one processor, said plurality of instructions cause the at least one processor to operate with the at least one display device to determine which of said displayed plurality of symbols are displayed indirectly adjacent to said displayed designated symbol, wherein said sub-set of symbols further includes said symbols determined to be displayed indirectly adjacent to said displayed designated symbol.

6. The gaming system of claim 1, wherein when executed by the at least one processor, said plurality of instructions cause the at least one processor to operate with the at least one display device to generate and display a plurality of designated symbols from said set of symbols.

7. The gaming system of claim 6, wherein when executed by the at least one processor, said plurality of instructions cause the at least one processor to operate with the at least one display device to enable the player to pick at least one of said plurality of displayed designated symbols, wherein said sub-set of symbols includes only the symbols displayed directly adjacent to said picked designated symbol.

8. A gaming system comprising: at least one display device; at least one input device; at least one processor; and at least one memory device which stores a plurality of instructions, which when executed by the at least one processor, cause the at least one processor to operate with the at least one display device and the at least one input device to: (a) enable a player to place a wager to play a primary game; (b) generate and display a plurality of symbols from a set of symbols for the play of the primary game, wherein at least one symbol of said set of symbols is a designated symbol; (c) determine if said displayed plurality of symbols from said set of symbols form any of a plurality of winning symbol combinations; (d) if said displayed plurality of symbols from said set of symbols form any of the winning symbol combinations, provide any awards associated with said winning symbol combinations; and (e) if said displayed plurality of symbols include said at least one designated symbol from said set of symbols: (i) determine which of said displayed plurality of symbols are displayed in symbol position locations having a predetermined relationship to the symbol position location of said at least one displayed designated symbol; (ii) determine a sub-set of said displayed plurality of symbols, wherein said sub-set of symbols includes said displayed plurality of symbols that are determined to be displayed in said symbol position locations having the predetermined relationship to the symbol position location of said at least one displayed designated symbol, and said sub-set includes fewer than all and not all of said displayed plurality of symbols; (iii) randomly generate and display a plurality of symbols from said sub-set of symbols; (iv) determine if the displayed plurality of symbols from said sub-set of symbols form any of the winning symbol combinations; and (v) if the displayed plurality of symbols from said sub-set of symbols form any of the winning symbol combinations, provide any additional awards associated with said formed winning symbol combinations.

9. The gaming system of claim 8, wherein when executed by the at least one processor, said plurality of instructions cause the at least one processor to operate with the display device to repeat (e)(iii) to (e)(v) at least once.

10. The gaming system of claim 8, wherein said symbol position locations having the predetermined relationship to the symbol position location of said displayed designated symbol are symbol position locations indirectly adjacent to said designated symbol, wherein said sub-set of symbols includes only said displayed plurality of symbols determined to be displayed in symbol positions locations indirectly adjacent to said displayed designated symbol.

11. The gaming system of claim 8, wherein when executed by the at least one processor, said plurality of instructions cause the at least one processor to operate with the at least one display device to generate and display a plurality of designated symbols from said set of symbols.

12. The gaming system of claim 11, wherein when executed by the at least one processor, said plurality of instructions cause the at least one processor to operate with the at least one display device to enable the player to pick at least one of said plurality of displayed designated symbols, wherein said sub-set of symbols includes only symbols displayed in symbol position locations having the predetermined relationship to the symbol position location of said picked designated symbol.

13. The gaming system of claim 8, wherein when executed by the at least one processor, said plurality of instructions cause the at least one processor to operate with the at least one display device to enable the player to pick at least one of said displayed plurality of symbols displayed in symbol position locations having the predetermined relationship to the symbol position location of said displayed designated symbol, wherein said sub-set of symbols includes only the symbols the player picked.

14. A method of operating a gaming system, said method comprising: causing at least one processor to operate with at least one display device and at least one input device to: (a) enable a player to place a wager to play a primary game; (b) generate and display a plurality of symbols from a set of symbols for the play of the primary game, wherein at least one symbol of said set of symbols is a designated symbol; (c) determine if said displayed plurality of symbols from said set of symbols form any of a plurality of winning symbol combinations; (d) if said displayed plurality of symbols from said set of symbols form any of the winning symbol combinations, provide any awards associated with said formed winning symbol combinations; and (e) if said displayed plurality of symbols include said at least one designated symbol: (i) determine which of said displayed plurality of symbols are displayed directly adjacent to said at least one displayed designated symbol; (ii) determine a sub-set of said displayed plurality of symbols, wherein said sub-set of symbols includes said displayed plurality of symbols that are determined to be displayed directly adjacent to said at least one displayed designated symbol, and said sub-set includes fewer than all and not all of said displayed plurality of symbols; (iii) randomly generate and display a plurality of symbols from said sub-set of symbols; (iv) determine if the displayed plurality of symbols from said sub-set of symbols form any of the winning symbol combinations; and (v) if the displayed plurality of symbols from said sub-set of symbols form any of the winning symbol combinations, provide any additional awards associated with said formed winning symbol combinations.

15. The method of claim 14, which includes causing the at least one processor to operate with the at least one display device to repeat (e)(iii) to (e)(v) at least once.

16. The method of claim 14, wherein the sub-set includes only symbols determined to be displayed directly adjacent to said designated symbol.

17. The method of claim 14, which includes causing the at least one processor to operate with the at least one display device and the at least one input device to enable the player to pick at least one of said symbols displayed directly adjacent to said designated symbol, wherein said sub-set of symbols includes only the symbols the player picked.

18. The method of claim 14, which includes causing the at least one processor to operate with the at least one display device to determine which of said displayed plurality of symbols are displayed indirectly adjacent to said displayed designated symbol, wherein said sub-set of symbols further includes said symbols determined to be displayed indirectly adjacent to said displayed designated symbol.

19. The method of claim 14, which includes causing the at least one processor to operate with the at least one display device to generate and display a plurality of designated symbols from said sub-set of symbols.

20. The method of claim 19, which includes causing the at least one processor to operate with the at least one display device and the at least one input device to enable the player to pick at least one of said plurality of displayed designated symbols, wherein said sub-set of symbols includes only the symbols displayed directly adjacent to said picked designated symbol.

21. The method of claim 14, which is provided through a data network.

22. The method of claim 21, wherein the data network is an internet.

23. A method of operating a gaming system, said method comprising: causing at least one processor to operate with at least one display device and at least one input device to: (a) enable a player to place a wager to play a primary game; (b) generate and display a plurality of symbols from a set of symbols for the play of the primary game, wherein at least one symbol of said set of symbols is a designated symbol; (c) determine if said displayed plurality of symbols from said set of symbols form any of a plurality of winning symbol combinations; (d) if said displayed plurality of symbols from said set of symbols form any of the winning symbol combinations, provide any awards associated with said winning symbol combinations; and (e) if said displayed plurality of symbols include said at least one designated symbol from said set of symbols: (i) determine which of said displayed plurality of symbols are displayed in symbol position locations having a predetermined relationship to the symbol position location of said at least one displayed designated symbol; (ii) determine a sub-set of said displayed plurality of symbols, wherein said sub-set of symbols includes said displayed plurality of symbols that are determined to be displayed in said symbol position locations having the predetermined relationship to the symbol position location of said at least one displayed designated symbol, and said sub-set includes fewer than all and not all of said displayed plurality of symbols; (iii) randomly generate and display a plurality of symbols from said sub-set of symbols; (iv) determine if the displayed plurality of symbols from said sub-set of symbols form any of the winning symbol combinations; and (v) if the displayed plurality of symbols from said sub-set of symbols form any of the winning symbol combinations, provide any additional awards associated with said formed winning symbol combinations.

24. The method of claim 23, which includes causing the at least one processor to operate with the at least one display device to repeat (e)(iii) to (e)(v) at least once.

25. The method of claim 23, wherein said symbol position locations having the predetermined relationship to the symbol position location of said displayed designated symbol are symbol position locations indirectly adjacent to said designated symbol, wherein said sub-set of symbols includes only said displayed plurality of symbols determined to be displayed in symbol positions locations indirectly adjacent to said displayed designated symbol.

26. The method of claim 23, which includes causing the at least one processor to operate with the at least one display device to generate and display a plurality of designated symbols from said set of symbols.

27. The method of claim 26, which includes causing the at least one processor to operate with the at least one display device and the at least one input device to enable the player to pick at least one of said plurality of displayed designated symbols, wherein said sub-set of symbols includes only symbols displayed in symbol position locations having the predetermined relationship to the symbol position location of said picked designated symbol.

28. The method of claim 23, which includes causing the at least one processor to operate with the at least one display device and the at least one input device to enable the player to pick at least one of said displayed plurality of symbols displayed in symbol position locations having the predetermined relationship to the symbol position location of said displayed designated symbol, wherein said sub-set of symbols includes only the symbols the player picked.

29. The method of claim 23, which is provided through a data network.

30. The method of claim 29, wherein the data network is an internet.

31. A non-transitory computer readable medium including a plurality of instructions, which when executed by at least one processor, cause the at least one processor to operate with at least one display device and at least one input device to: (a) enable a player to place a wager to play a primary game; (b) generate and cause the at least one display device to display a plurality of symbols from a set of symbols for the play of the primary game, wherein at least one symbol of said set of symbols is a designated symbol; (c) determine if said displayed plurality of symbols from said set of symbols form any of a plurality of winning symbol combinations; (d) if said displayed plurality of symbols from said set of symbols form any of the winning symbol combinations, provide any awards associated with said formed winning symbol combinations; and (e) if said displayed plurality of symbols include said at least one designated symbol: (i) determine which of said displayed plurality of symbols are displayed directly adjacent to said at least one displayed designated symbol; (ii) determine a sub-set of said displayed plurality of symbols, wherein said sub-set of symbols includes said displayed plurality of symbols that are determined to be displayed directly adjacent to said at least one displayed designated symbol, and said sub-set includes fewer than all and not all of said displayed plurality of symbols; (iii) randomly generate and cause the at least one display device to display a plurality of symbols from said sub-set of symbols; (iv) determine if the displayed plurality of symbols from said sub-set of symbols form any of the winning symbol combinations; and (vi) if the displayed plurality of symbols from said sub-set of symbols form any of the winning symbol combinations, provide any additional awards associated with said formed winning symbol combinations.

32. The non-transitory computer readable medium of claim 31, wherein when executed by the at least one processor, said plurality of instructions cause the at least one processor to operate with the at least one display device to repeat (e)(iii) to (e)(v) at least once.

33. The non-transitory computer readable medium of claim 31, wherein the sub-set includes only symbols determined to be displayed directly adjacent to said designated symbol.

34. The non-transitory computer readable medium of claim 31, wherein when executed by the at least one processor, said plurality of instructions cause the at least one processor to operate with the at least one display device and the at least one input device to enable the player to pick at least one of said symbols displayed directly adjacent to said designated symbol, wherein said sub-set of symbols includes only the symbols the player picked.

35. The non-transitory computer readable medium of claim 31, wherein when executed by the at least one processor, said plurality of instructions cause the at least one processor to operate with the at least one display device to determine which of said displayed plurality of symbols are displayed indirectly adjacent to said displayed designated symbol, wherein said sub-set of symbols further includes said symbols determined to be displayed indirectly adjacent to said displayed designated symbol.

36. The non-transitory computer readable medium of claim 31, wherein when executed by the at least one processor, said plurality of instructions cause the at least one processor to operate with the at least one display device to generate and display a plurality of designated symbols from said set of symbols.

37. The non-transitory computer readable medium of claim 36, wherein when executed by the at least one processor, said plurality of instructions cause the at least one processor to operate with the at least one display device and the at least one input device to enable the player to pick at least one of said plurality of displayed designated symbols, wherein said sub-set of symbols includes only the symbols displayed directly adjacent to said picked designated symbol.

38. A non-transitory computer readable medium including a plurality of instructions, which when executed by at least one processor, cause the at least one processor to operate with at least one display device and at least one input device to: (a) enable a player to place a wager to play a primary game; (b) generate and cause the at least one display device to display a plurality of symbols from a set of symbols for the play of the primary game, wherein at least one symbol of said set of symbols is a designated symbol; (c) determine if said displayed plurality of symbols from said set of symbols form any of a plurality of winning symbol combinations; (d) if said displayed plurality of symbols from said set of symbols form any of the winning symbol combinations, provide any awards associated with said winning symbol combinations; and (e) if said displayed plurality of symbols include said at least one designated symbol from said set of symbols: (i) determine which of said displayed plurality of symbols are displayed in symbol position locations having a predetermined relationship to the symbol position location of said at least one displayed designated symbol; (ii) determine a sub-set of said displayed plurality of symbols, wherein said sub-set of symbols includes said displayed plurality of symbols that are determined to be displayed in said symbol position locations having the predetermined relationship to the symbol position location of said at least one displayed designated symbol, and said sub-set includes fewer than all and not all of said displayed plurality of symbols; (iii) randomly generate and cause the at least one display device to display a plurality of symbols from said sub-set of symbols; (iv) determine if the displayed plurality of symbols from said sub-set of symbols form any of the winning symbol combinations; and (v) if the displayed plurality of symbols from said sub-set of symbols form any of the winning symbol combinations, provide any additional awards associated with said formed winning symbol combinations.

39. The non-transitory computer readable medium of claim 38, wherein when executed by the at least one processor, said plurality of instructions cause the at least one processor to operate with the at least one display device to repeat (e)(iii) to (e)(v) at least once.

40. The non-transitory computer readable medium of claim 38, wherein said symbol position locations having the predetermined relationship to the symbol position location of said displayed designated symbol are symbol position locations indirectly adjacent to said designated symbol, wherein said sub-set of symbols includes only said displayed plurality of symbols determined to be displayed in symbol positions locations indirectly adjacent to said displayed designated symbol.

41. The non-transitory computer readable medium of claim 38, wherein when executed by the at least one processor, said plurality of instructions cause the at least one processor to operate with the at least one display device to generate and display a plurality of designated symbols from said sub-set of symbols.

42. The non-transitory computer readable medium of claim 41, wherein when executed by the at least one processor, said plurality of instructions cause the at least one processor to operate with the at least one display device and the at least one input device to enable the player to pick at least one of said plurality of displayed designated symbols, wherein said sub-set of symbols includes only symbols displayed in symbol position locations having the predetermined relationship to the symbol position location of said picked designated symbol.

43. The non-transitory computer readable medium of claim 38, wherein when executed by the at least one processor, said plurality of instructions cause the at least one processor to operate with the at least one display device and the at least one input device to enable the player to pick at least one of said displayed plurality of symbols displayed in symbol position locations having the predetermined relationship to the symbol position location of said displayed designated symbol, wherein said sub-set of symbols includes only the symbols the player picked.

* * * * *

UNITED STATES PATENT AND TRADEMARK OFFICE

CERTIFICATE OF CORRECTION

PATENT NO. : 8,113,942 B2
APPLICATION NO. : 12/268552
DATED : February 14, 2012
INVENTOR(S) : Benjamin C. Hoffman et al.

It is certified that error appears in the above-identified patent and that said Letters Patent is hereby corrected as shown below:

IN THE CLAIMS:

In Claim 1, Column 33, Line 57, between "plurality of" and "symbols" insert --the--.

In Claim 3, Column 34, Line 3, between "said" and "designated" add --at least one displayed--.

In Claim 4, Column 34, Line 8, between "said" and "designated" add --at least one displayed--.

In Claim 5, Column 34, Line 15, between "said" and "displayed" add --at least one--.

In Claim 5, Column 34, Line 18, between "said" and "displayed" add --at least one--.

In Claim 8, Column 34, Line 50, replace "the" with --a--.

In Claim 8, Column 34, Line 59, between "plurality of" and "symbols" insert --the--.

In Claim 10, Column 35, Line 5, between "said" and "displayed" add --at least one--.

In Claim 10, Column 35, Line 7, between "said" and "designated" add --at least one displayed--.

In Claim 10, Column 35, Line 10, between "said" and "displayed" add --at least one--.

In Claim 12, Column 35, Line 24, replace "the" with --a--.

In Claim 13, Column 35, line 32, between "said" and "displayed" add --at least two--.

In Claim 14, Column 35, Line 57, between "plurality of" and "symbols" add --the--.

In Claim 16, Column 36, Line 3, between "said" and "designated" add --at least one displayed--.

In Claim 17, Column 36, Line 8, between "said" and "designated" add --at least one displayed--.

In Claim 18, Column 36, Line 13, between "said" and "displayed" add --at least one--.

In Claim 18, Column 36, Line 16, between "said" and "displayed" add --at least one--.

In Claim 23, Column 36, Line 49, replace "the" with --a--.

In Claim 23, Column 36, Lines 59 to 60, between "plurality of" and "symbols" insert --the--.

In Claim 25, Column 37, Line 3, between "said" and "displayed" insert --at least one--.

In Claim 25, Column 37, Lines 4 to 5, between "said" and "designated" insert --at least one displayed--.

In Claim 25, Column 37, Line 8, between "said" and "displayed" insert --at least one--.

Signed and Sealed this
Fourth Day of September, 2012

David J. Kappos

David J. Kappos
*Director of the United States Patent and Trademark Office*

IN THE CLAIMS:

In Claim 27, Column 37, Line 20, replace “the” with --a--.

In Claim 28, Column 37, Line 27, between “said” and “displayed” insert --at least one--.

In Claim 31, Column 37, Line 58, between “plurality of” and “symbols” insert --the--.

In Claim 33, Column 38, Line 6, between “said” and “designated” insert --at least one displayed--.

In Claim 34, Column 38, Line 12, between “said” and “designated” insert --at least one displayed--.

In Claim 35, Column 38, Line 20, between “said” and “displayed” insert --at least one--.

In Claim 35, Column 38, Line 22, after “said” insert --at least one--.

In Claim 38, Column 38, Line 56, replace “the” with --a--.

In Claim 38, Column 38, Line 56, after “of” add --the--.

In Claim 40, Column 39, Line 14, before “displayed” add --at least one--.

In Claim 40, Column 39, Line 15, between “said” and “designated” add --at least one displayed--.

In Claim 40, Column 39, Line 18, between “said” and “displayed” add --at least one--.

In Claim 42, Column 40, Line 9, replace “the” with --a--.

In Claim 43, Column 40, Line 18, between “said” and “displayed” add --at least one--.